US010068577B2

(12) United States Patent
Melkote et al.

(10) Patent No.: US 10,068,577 B2
(45) Date of Patent: Sep. 4, 2018

(54) AUDIO SEGMENTATION BASED ON SPATIAL METADATA

(71) Applicant: Dolby Laboratories Licensing Corporation, San Francisco, CA (US)

(72) Inventors: Vinay Melkote, Bangalore (IN); Malcolm James Law, Steyning (GB); Roy M. Fejgin, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/306,051

(22) PCT Filed: Apr. 23, 2015

(86) PCT No.: PCT/US2015/027234
§ 371 (c)(1),
(2) Date: Oct. 21, 2016

(87) PCT Pub. No.: WO2015/164572
PCT Pub. Date: Oct. 29, 2015

(65) Prior Publication Data

US 2017/0047071 A1 Feb. 16, 2017

Related U.S. Application Data

(60) Provisional application No. 61/984,634, filed on Apr. 25, 2014.

(51) Int. Cl.
*G10L 19/00* (2013.01)
*G10L 19/008* (2013.01)
(Continued)

(52) U.S. Cl.
CPC ..... *G10L 19/0017* (2013.01); *G10L 19/008* (2013.01); *G10L 19/20* (2013.01); *G10L 19/167* (2013.01); *H04S 2400/11* (2013.01)

(58) Field of Classification Search
CPC ..... H04L 27/06
(Continued)

(56) References Cited

U.S. PATENT DOCUMENTS 6,493,399 B1 * 12/2002 Xia ..... H04L 1/06 375/229
6,611,212 B1 * 8/2003 Craven ..... G11B 20/00992 341/50
(Continued)

FOREIGN PATENT DOCUMENTS

RS 1332 U 8/2013
WO 2005/031597 4/2005
(Continued)

OTHER PUBLICATIONS

Tanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.
(Continued)

*Primary Examiner* — Michael Colucci

(57) ABSTRACT

A method of encoding adaptive audio, comprising receiving N objects and associated spatial metadata that describes the continuing motion of these objects, and partitioning the audio into segments based on the spatial metadata. The method encodes adaptive audio having objects and channel beds by capturing a continuing motion of a number N objects in a time-varying matrix trajectory comprising a sequence of matrices, coding coefficients of the time-varying matrix trajectory in spatial metadata to be transmitted via a high-definition audio format for rendering the adaptive audio through a number M output channels, and segmenting the sequence of matrices into a plurality of sub-segments based on the spatial metadata, wherein the plurality of
(Continued)

sub-segments are configured to facilitate coding of one or more characteristics of the adaptive audio.

20 Claims, 7 Drawing Sheets

(51) Int. Cl.
*G10L 19/20* (2013.01)
*G10L 19/16* (2013.01)

(58) Field of Classification Search
USPC ..... 704/5, 265; 375/267; 712/31; 709/225
See application file for complete search history.

(56) References Cited

U.S. PATENT DOCUMENTS

| | | | | |
|---|---|---|---|---|
| 7,693,551 | B2 * | 4/2010 | Ojard | H01Q 21/00 375/259 |
| 8,411,806 | B1 * | 4/2013 | Lee | H04L 25/03305 375/340 |
| 8,467,466 | B2 * | 6/2013 | Bjerke | H04L 1/005 375/262 |
| 8,468,244 | B2 * | 6/2013 | Redlich | G06Q 10/06 705/50 |
| 9,160,578 | B2 * | 10/2015 | Paker | H04L 25/0246 |
| 2005/0018796 | A1 * | 1/2005 | Sande | H03H 17/0266 375/350 |
| 2005/0203744 | A1 * | 9/2005 | Tamura | G10L 21/02 704/265 |
| 2006/0206221 | A1 * | 9/2006 | Metcalf | G10H 1/0091 700/94 |
| 2008/0175394 | A1 * | 7/2008 | Goodwin | H04S 3/008 381/1 |
| 2010/0067600 | A1 * | 3/2010 | Kim | H04L 25/03159 375/267 |
| 2010/0080317 | A1 * | 4/2010 | Narasimhan | H04B 7/0617 375/267 |
| 2012/0159122 | A1 * | 6/2012 | Anderson | H04B 7/0854 712/31 |
| 2012/0287981 | A1 * | 11/2012 | Xiao | H04B 7/0626 375/224 |
| 2013/0287131 | A1 * | 10/2013 | Hart | H04B 7/0456 375/267 |
| 2014/0056334 | A1 * | 2/2014 | Khina | H04L 25/0204 375/211 |

FOREIGN PATENT DOCUMENTS

| | | |
|---|---|---|
| WO | 2005/098823 | 10/2005 |
| WO | 2007/016107 | 2/2007 |
| WO | 2012/045203 | 4/2012 |
| WO | 2013/006338 | 1/2013 |
| WO | 2013/192111 | 12/2013 |
| WO | 2014/014600 | 1/2014 |
| WO | 2014/046916 | 3/2014 |
| WO | 2015/048387 | 4/2015 |
| WO | 2015/164575 | 10/2015 |

OTHER PUBLICATIONS

Stanojevic, T. et al "Designing of TSS Halls" 13th International Congress on Acoustics, Yugoslavia, 1989.
Stanojevic, T. et al "The Total Surround Sound (TSS) Processor" SMPTE Journal, Nov. 1994.
Stanojevic, T. et al "The Total Surround Sound System", 86th AES Convention, Hamburg, Mar. 7-10, 1989.
Stanojevic, T. et al "TSS System and Live Performance Sound" 88th AES Convention, Montreux, Mar. 13-16, 1990.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.
Stanojevic, Tomislav "3-D Sound in Future HDTV Projection Systems" presented at the 132nd SMPTE Technical Conference, Jacob K. Javits Convention Center, New York City, Oct. 13-17, 1990.
Stanojevic, Tomislav "Surround Sound for a New Generation of Theaters, Sound and Video Contractor" Dec. 20, 1995.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.
Gerzon, M.A. "The MLP Lossless Compression System for PCM Audio" J. AES, vol. 52, No. 3, pp. 243-260, Mar. 2004.
DVD Specification: MLP Reference Information Version 1.01, Jan. 2008, pp. 1-101.

* cited by examiner

AUDIO SEGMENTATION BASED ON SPATIAL METADATA

CROSS-REFERENCE TO RELATED APPLICATION

This application claims priority to U.S. Provisional Patent Application No. 61/984,634 filed Apr. 25, 2014 which is hereby incorporated by reference in its entirety for all purposes.

FIELD OF THE INVENTION

Embodiments relate generally to adaptive audio signal processing, and more specifically to segmenting audio using spatial metadata describing the motion of audio objects to derive a downmix matrix for rendering the objects to discrete speaker channels.

BACKGROUND

New professional and consumer-level audio-visual (AV) systems (such as the Dolby® Atmos™ system) have been developed to render hybrid audio content using a format that includes both audio beds (channels) and audio objects. Audio beds refer to audio channels that are meant to be reproduced in predefined, fixed speaker locations (e.g., 5.1 or 7.1 surround) while audio objects refer to individual audio elements that exist for a defined duration in time and have spatial information describing the position, velocity, and size (as examples) of each object. During transmission beds and objects can be sent separately and then used by a spatial reproduction system to recreate the artistic intent using a variable number of speakers in known physical locations. Based on the capabilities of an authoring system there may be tens or even hundreds of individual audio objects (static and/or time-varying) that are combined during rendering to create a spatially diverse and immersive audio experience. In an embodiment, the audio processed by the system may comprise channel-based audio, object-based audio or object and channel-based audio. The audio comprises or is associated with metadata that dictates how the audio is rendered for playback on specific devices and listening environments. In general, the terms "hybrid audio" or "adaptive audio" are used to mean channel-based and/or object-based audio signals plus metadata that renders the audio signals using an audio stream plus metadata in which the object positions are coded as a 3D position in space.

Adaptive audio systems thus represent the sound scene as a set of audio objects in which each object is comprised of an audio signal (waveform) and time varying metadata indicating the position of the sound source. Playback over a traditional speaker set-up such as a 7.1 arrangement (or other surround sound format) is achieved by rendering the objects to a set of speaker feeds. The process of rendering comprises in large part (or solely) a conversion of the spatial metadata at each time instant into a corresponding gain matrix, which represents how much of each of the object feeds into a particular speaker. Thus, rendering "N" audio objects to "M" speakers at time "t" (t) can be represented by the multiplication of a vector x(t) of length "N", comprised of the audio sample at time t from each object, by an "M-by-N" matrix A(t) constructed by appropriately interpreting the associated position metadata (and any other metadata such as object gains) at time t. The resultant samples of the speaker feeds at time t are represented by the vector y(t). This is shown below in Eq. 1:

$$\underbrace{\begin{bmatrix} y_0(t) \\ y_1(t) \\ \vdots \\ y_{M-1}(t) \end{bmatrix}}_{y(t)} = \underbrace{\begin{bmatrix} a_{00}(t) & a_{01}(t) & a_{02}(t) & \dots & a_{0,N-1}(t) \\ a_{10}(t) & \vdots & \vdots & \vdots & \vdots \\ \vdots & \vdots & \vdots & \vdots & \vdots \\ a_{M-1,0}(t) & \vdots & \vdots & \vdots & a_{M-1,N-1}(t) \end{bmatrix}}_{A(t)} \underbrace{\begin{bmatrix} x_0(t) \\ x_1(t) \\ x_2(t) \\ \vdots \\ x_{N-1}(t) \end{bmatrix}}_{x(t)} \quad \text{(Eq. 1)}$$

The matrix equation of Eq. 1 above represents an adaptive audio (e.g., Atmos) rendering perspective, but it can also represent a generic set of scenarios where one set of audio samples is converted to another set by linear operations. In an extreme case A(t) is a static matrix and may represent a conventional downmix of a set of audio channels x(t) to a fewer set of channels y(t). For instance, x(t) could be a set of audio channels that describe a spatial scene in an Ambisonics format, and the conversion to speaker feeds y(t) may be prescribed as multiplication by a static downmix matrix. Alternatively, x(t) could be a set of speaker feeds for a 7.1 channel layout, and the conversion to a 5.1 channel layout may be prescribed as multiplication by a static downmix matrix.

To provide audio reproduction that is as accurate as possible, adaptive audio systems are often used with high-definition audio codecs (coder-decoder) systems, such as Dolby TrueHD. As an example of such codecs, Dolby TrueHD is an audio codec that supports lossless and scalable transmission of audio signals. The source audio is encoded into a hierarchy of substreams where only a subset of the substreams need to be retrieved from the bitstream and decoded, in order to obtain a lower dimensional (or downmix) presentation of the spatial scene, and when all the substreams are decoded the resultant audio is identical to the source audio. Although embodiments may be described and illustrated with respect to TrueHD systems, it should be noted that any other similar HD audio codec system may also be used. The term "TrueHD" is thus meant to include all possible HD type codecs. Technical details of Dolby TrueHD, and the Meridian Lossless Packing (MLP) technology on which it is based, are well known. Aspects of TrueHD and MLP technology are described in U.S. Pat. No. 6,611,212, issued Aug. 26, 2003, and assigned to Dolby Laboratories Licensing Corp., and the paper by Gerzon, et al., entitled "The MLP Lossless Compression System for PCM Audio," J. AES, Vol. 52, No. 3, pp. 243-260 (March 2004).

TrueHD supports specification of downmix matrices. In typical use, the content creator of a 7.1 channel audio program specifies a static matrix to downmix the 7.1 channel program to a 5.1 channel mix, and another static matrix to downmix the 5.1 channel downmix to a 2 channel (stereo) downmix Each static downmix matrix may be converted to a sequence of downmix matrices (each matrix in the sequence for downmixing a different interval in the program) in order to achieve clip-protection. However, each matrix in the sequence is transmitted (or metadata determining each matrix in the sequence is transmitted) to the decoder, and the decoder does not perform interpolation on any previously specified downmix matrix to determine a subsequent matrix in a sequence of downmix matrices for a program.

The TrueHD bitstream carries a set of output primitive matrices and channel assignments that are applied to the appropriate subset of the internal channels to derive the required downmix/lossless presentation. At the TrueHD encoder the primitive matrices are designed so that the specified downmix matrices can be achieved (or closely achieved) by the cascade of input channel assignment, input primitive matrices, output primitive, matrices and output channel assignment. If the specified matrix is static, i.e., time-invariant, it is possible to design the primitive matrices and channel assignments just once and employ the same decomposition throughout the audio signal. However when it is desired that the adaptive audio content be transmitted via TrueHD, such that the bitstream is hierarchical and supports deriving a number of downmixes by accessing only an appropriate subset of the internal channels, the specified downmix matrix/matrices evolve over time as the objects move. In this case a time-varying decomposition is needed and a single set of channel assignments will not work at all time (a set of channel assignments at a given time corresponds to the channel assignment for all the substreams in the bitstream at that time).

A "restart interval" in a TrueHD bitstream is a segment of audio that has been encoded such that it can be decoded independently of any segment that appears before or after it, i.e., it is a possible random access point. The TrueHD encoder divides up the audio signal into consecutive subsegments, each of which is encoded as a restart interval. A restart interval is typically constrained to be 8 to 128 access units (AUs) in length. An access unit (defined for a particular audio sampling frequency) is a segment of a fixed number of consecutive samples. At 48 kHz sampling frequency a TrueHD AU is of length 40 samples or spans 0.833 milliseconds. The channel assignment for each substream can only be specified once every restart interval as per constraints in the bitstream syntax. The rationale behind this is to group audio associated with similarly decomposable downmix matrices together into a restart interval, and benefit from bitrate savings associated with not having to send the channel assignment each time the downmix matrix is updated (within the restart).

In legacy TrueHD systems, the downmix specification generally static, and hence it is conceivable that a prototype decomposition/channel assignment could be employed for encoding the entire length of the audio signal. Thus, restart intervals could be made as large as possible (128 AUs), and the audio signal was divided uniformly into restart intervals of this maximum size. This is no more feasible in the case where adaptive audio content has to be transmitted via TrueHD since the downmix matrices are dynamic. In other words, it is necessary to examine the evolution of downmix matrices over time and divide the audio signal into intervals over which a single channel assignment could be employed to decompose the specified downmix matrices throughout that sub-segment. Therefore, it is advantageous to segment the audio into restart intervals of potentially varying length while accounting for the dynamics of the downmix matrix trajectory.

Current systems also do not utilize spatial cues of objects in adaptive audio content when segmenting the audio. Thus, it would also be advantageous to partition the audio into segments based on the spatial metadata associated with adaptive audio objects and that describes the continuing motion of these objects for rendering through discrete speaker channels.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Dolby, Dolby TrueHD, and Atmos are trademarks of Dolby Laboratories Licensing Corporation.

BRIEF SUMMARY OF EMBODIMENTS

Embodiments are directed to a method of encoding adaptive audio by receiving N objects and associated spatial metadata that describes the continuing motion of these objects, and partitioning the audio into segments based on the spatial metadata. The spatial metadata defines a time-varying matrix trajectory comprising a sequence of matrices at different time instants to render the N objects to M output channels, and the partitioning step comprises dividing the sequence of matrices into a plurality of segments. The method further comprises deriving a matrix decomposition for matrices in the sequence, and configuring the plurality of segments to facilitate coding of one or more characteristics of the adaptive audio including the decomposition parameters. The step of deriving the matrix decomposition comprises decomposing matrices in the sequence into primitive matrices and channel assignments, and wherein the decomposition parameters include channel assignments, primitive matrix channel sequence, and interpolation decisions regarding the primitive matrices.

The method may further comprise configuring the plurality of segments dividing the sequence of matrices such that one or more decomposition parameters can be held constant over the plurality of segments; or configuring the plurality of segments dividing the sequence of matrices such that the impact of any change in one or more decomposition parameters is minimal with regard to one or more performance characteristics including: compression efficiency, continuity in output audio, and audibility of discontinuities.

Embodiments of the method also include receiving one or more decomposition parameters for a matrix A(t1) at t1; and attempting to perform a decomposition of an adjacent matrix A(t2) at t2 into primitive matrices and channel assignments while enforcing the same decomposition parameters as at time t1, wherein the attempted decomposition is deemed as failed if the resulting primitive matrices do not satisfy one or more criterion, and is deemed successful if otherwise. The criterion to define the failure of the decomposition include one or more of the following: the primitive matrices obtained from the decomposition have coefficients whose values exceed limits prescribed by a signal processing system that incorporates the method; the achieved matrix, obtained as the product of primitive matrices and channel assignments differs from the specified matrix A(t2) by more than a defined threshold value, where the difference is measured by an error metric that depends at least on the achieved matrix and the specified matrix; and the encoding method involves applying one or more of the primitive matrices and channel assignments to a time-segment of the input audio, and a measure of the resultant peak audio signal is determined in the decomposition routine, and the measure exceeds a largest audio sample value that can be represented in a signal processing system that performs the method. The error metric is the maximum absolute difference between corresponding elements of the achieved matrix and the specified matrix A(t2).

According to the method, some of the primitive matrices are marked as input primitive matrices, and a product matrix of the input primitive matrices is calculated, and a value of a peak signal is determined for one or more rows of the product matrix is calculated, wherein the value of the peak signal for a row is the sum of absolute values of elements in that row of the product matrix, and the measure of the resultant peak audio signal is calculated as the maximum of one or more of these values. In a case where the decomposition is a failure, a segmentation boundary is inserted at time t1 or t2. In a case where the decomposition of A(t2) is a success, and wherein some of the primitive matrices are input primitive matrices and a channel assignment is an input channel assignment, and the primitive matrix channel sequence for input primitive matrices at t1 and t2, and input channel assignments at t1 and t2 are the same, and interpolation slope parameters are determined for interpolating the input primitive matrices between t1 and t2.

In an embodiment of the method, A(t1) and A(t2) are matrices in the matrix defined at time instants t1 and t2, and the method further involves: decomposing both A(t1) and A(t2) into primitive matrices and channel assignments; identifying at least some of the primitive matrices at t1 and t2 as output primitive matrices; interpolating one or more of the primitive matrices between t1 and t2; deriving, in the encoding method, an M-channel downmix of the N-input channels by applying the primitive matrices with interpolation to the input audio; determining if the derived M-channel downmix clips; and modifying output primitive matrices at t1 and/or t2 so that applying the modified primitive matrices to the N-input channels results in an M-channel downmix that does not clip.

In an embodiment, the primitive matrices and channel assignments are encoded in a high definition audio format bitstream that is transmitted between an encoder and decoder of an audio processing system for rendering the N objects to speaker feeds corresponding to the M channels. The method further comprising decoding the bitstream in the decoder to apply the primitive matrices and channel assignments to a set of internal channels to derive a lossless presentation and one or more downmix presentations of an input audio program, and wherein the internal channels are internal to the encoder and decoder of the audio processing system. The sub-segments are restart intervals that may be of identical or different time periods.

Embodiments are further directed to systems and articles of manufacture that perform or embody processing commands that perform or implement the above-described method acts.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Systems and methods are described for segmenting the adaptive audio content into restart intervals of potentially varying length while accounting for the dynamics of the downmix matrix trajectory. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
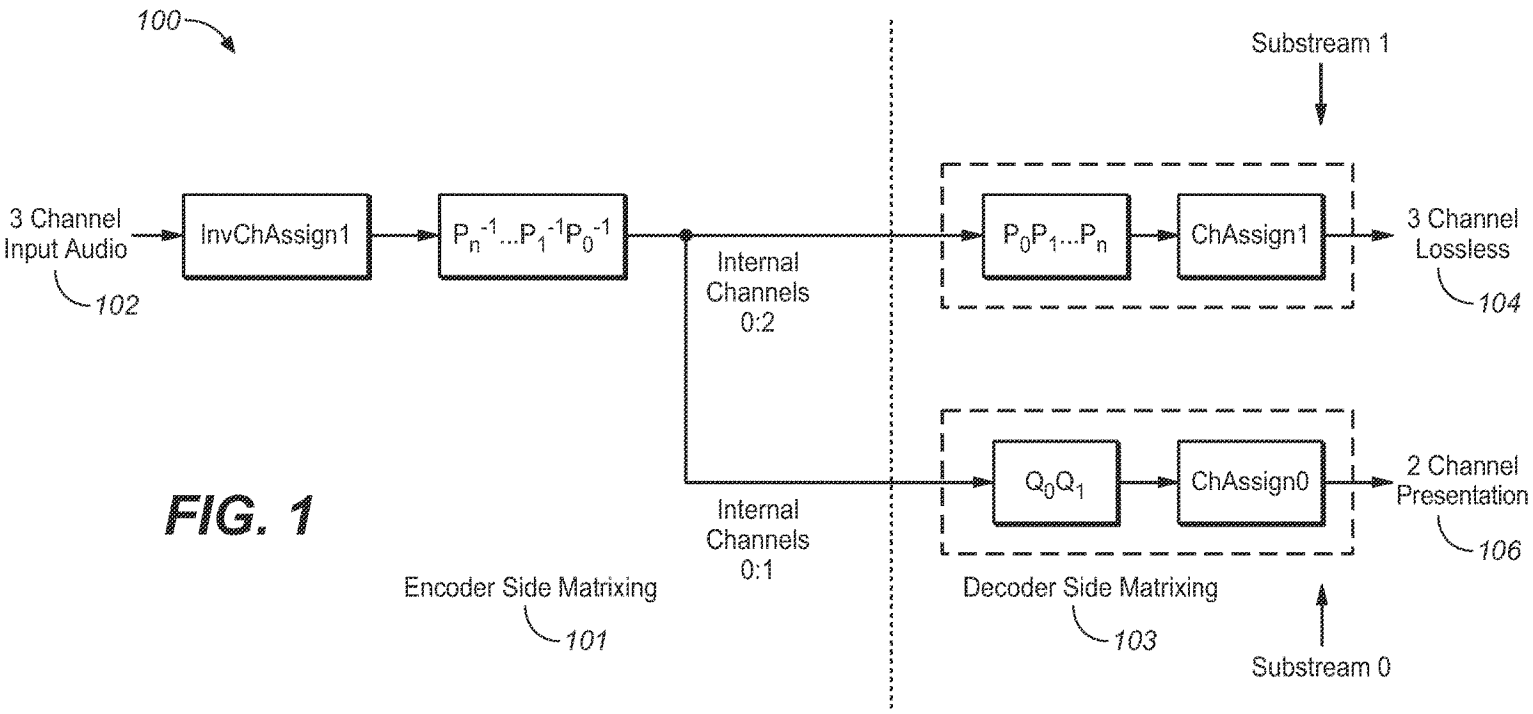
FIG. 1 illustrates a schematic of matrixing operations in a high-definition audio encoder and decoder for a particular downmixing scenario.

Embodiments are directed to an audio segmentation and encoding process for use in encoder/decoder systems transmitting adaptive audio content via a high-definition audio (e.g., TrueHD) format using substreams containing downmix matrices and channel assignments. FIG. 1 shows an example of a downmix system for an input audio signal having three input channels packaged into two substreams 104 and 106, where the first substream is sufficient to retrieve a two-channel downmix of the original three channels, and the two substreams together enable retrieving the original three-channel audio losslessly. As shown in FIG. 1, encoder 101 and decoder-side 103 perform matrixing operations for input stream 102 containing two substreams denoted Substream 1 and Substream 0 that produce lossless or downmixed outputs 104 and 106, respectively. Substream 1 comprises matrix sequence $P_0, P_1, \ldots P_n$, and a channel assignment matrix ChAssign1; and Substream 0 comprises matrix sequence $Q_0$ $Q_1$, and a channel assignment matrix ChAssign0. Substream 1 reproduces a lossless version of the original input audio original as output 106, and Substream 0 produces a downmix presentation 106. A downmix decoder may decode only substream 0.

At the encoder 101, the three input channels are converted into three internal channels (indexed 0, 1, and 2) via a sequence of (input) matrixing operations. The decoder 103 converts the internal channels to the required downmix 106 or lossless 104 presentations by applying another sequence of (output) matrixing operations. Simplistically speaking, the audio (e.g., TrueHD) bitstream contains a representation of these three internal channels and sets of output matrices, one corresponding to each substream. For instance, the Substream 0 contains the set of output matrices $Q_0$, $Q_1$ that are each of dimension 2*2 and multiply a vector of audio samples of the first two internal channels (ch0 and ch1). These combined with a corresponding channel permutation (equivalent to multiplication by a permutation matrix) represented here by the box titled "ChAssign0" yield the required two channel downmix of the three original audio channels. The sequence/product of matrixing operations at the encoder and decoder is equivalent to the required downmix matrix specification that transforms the three input audio channels to the downmix.

The output matrices of Substream 1 ($P_0, P_p \ldots, P_a$), along with a corresponding channel permutation (ChAssign1) result in converting the internal channels back into the input three-channel audio. In order that the output three-channel audio is exactly the same as the input three-channel audio (lossless characteristic of the system), the matrixing operations at the encoder should be exactly (including quantization effects) the inverse of the matrixing operations of the lossless substream in the bitstream. Thus, for system 100, the matrixing operations at the encoder have been depicted as the inverse matrices in the opposite sequence $P_n^{-1}, \ldots P_1^{-1}, P_0^{-1}$. Additionally, note that the encoder applies the inverse of the channel permutation at the decoder through the "InvChAssign1" (inverse channel assignment 1) process at the encoder-side. For the example system 100 of FIG. 1, the term "substream" is used to encompass the channel assignments and matrices corresponding to a given presentation, e.g., downmix or lossless presentation. In practical applications, Substream 0 may have a representation of the samples in the first two internal channels (0:1) and Substream 1 will have a representation of samples in the third internal channel (0:2). Thus a decoder that decodes the presentation corresponding to Substream 1 (the lossless presentation) will have to decode both substreams. However, a decoder that produces only the stereo downmix may decode substream 0 alone. In this manner, the TrueHD format is scalable or hierarchical in the size of the presentation obtained.

Given a downmix matrix specification (for instance, in this case it could be a static specification A that is 2*3 in dimension), the objective of the encoder is to design the output matrices (and hence the input matrices), and output channel assignments (and hence the input channel assignment) so that the resultant internal audio is hierarchical, i.e., the first two internal channels are sufficient to derive the 2-channel presentation, and so on; and the matrices of the top most substream are exactly invertible so that the input audio is exactly retrievable. However, it should be noted that computing systems work with finite precision and inverting an arbitrary invertible matrix exactly often requires very large precision calculations. Thus, downmix operations using TrueHD codec systems generally require a large number of bits to represent matrix coefficients.

As stated previously, TrueHD (and other possible HD audio formats) try to minimize the precision requirements of inverting arbitrary invertible matrices by constraining the matrices to be primitive matrices. A primitive matrix P of dimension N*N is of the form shown in Eq. 2 below:

$$P = \begin{bmatrix} 1 & 0 & \ddots & \ddots & 0 \\ 0 & 1 & 0 & \ddots & \ddots \\ \alpha_0 & \alpha_1 & \alpha_2 & \ddots & \alpha_{N-1} \\ \vdots & \ddots & \ddots & \ddots & \ddots \\ 0 & 0 & 0 & 0 & 1 \end{bmatrix} \quad \text{(Eq. 2)}$$

This primitive matrix is identical to the identity matrix of dimension N*N except for one (non-trivial) row. When a primitive matrix, such as P, operates on or multiplies a vector such as x(t) the result is the product Px(t), another N-dimensional vector that is exactly the same as x(t) in all elements except one. Thus each primitive matrix can be associated with a unique channel, which it manipulates, or on which it operates. A primitive matrix only alters one channel of a set (vector) of samples of audio program channels, and a unit primitive matrix is also losslessly invertible due to the unit values on the diagonal.

If $\alpha_2=1$ (resulting in a unit diagonal in P), it is seen that the inverse of P is exactly as shown in Eq. 3 below:

$$P^{-1} = \begin{bmatrix} 1 & 0 & \ddots & \ddots & 0 \\ 0 & 1 & 0 & \ddots & \ddots \\ -\alpha_0 & -\alpha_1 & 1 & \ddots & -\alpha_{N-1} \\ \vdots & \ddots & \ddots & \ddots & \ddots \\ 0 & 0 & 0 & 0 & 1 \end{bmatrix} \quad \text{(Eq. 3)}$$

If the primitive matrices $P_0, P_1, \ldots, P_n$ in the decoder of FIG. 1 have unit diagonals the sequence of matrixing operations $P_n^{-1}, \ldots, P_1^{-1}, P_0^{-1}$ at the encoder and $P_0, P_1, \ldots, P_n$ at the decoder can be implemented by finite precision circuits. If $\alpha_2=-1$ it is seen that the inverse of P is itself, and in this case too the inverse can be implemented by finite precision circuits. The description will refer to primitive matrices that have a 1 or −1 as the element the non-trivial row shares with the diagonal, as unit primitive matrices. Thus, the diagonal of a unit primitive matrix consists of all positive ones, +1, or all negative ones, −1, or some positive ones and some negative ones. Although unit primitive matrix refers to a primitive matrix whose non-trivial row has a diagonal element of +1, all references to unit primitive matrices herein, including in the claims, are intended to cover the more generic case where a unit primitive matrix can have a non-trivial row whose shared element with the diagonal is +1 or −1.

A channel assignment or channel permutation refers to a reordering of channels. A channel assignment of N channels can be represented by a vector of N indices $c_N=[c_0\ c_1, \ldots c_{N-1}]$, $c_i \in \{0, 1, \ldots, N-1\}$ and $c_i \neq c_j$ if $i \neq j$. In other words the channel assignment vector contains the elements 0, 1, 2, . . . , N−1 in some particular order, with no element repeated. The vector indicates that the original channel i will be remapped to the position $c_i$. Clearly applying the channel assignment $c_N$ to a set of N channels at time t, can be represented by multiplication with an N*N permutation matrix [1]$C_N$ whose column i is a vector of N elements with all zeros except for a 1 in the row $c_i$.

For instance, the 2-element channel assignment vector [1 0] applied to a pair of channels Ch0 and Ch1 implies that the first channel Ch0' after remapping is the original Ch1 and the second channel Ch1' after remapping is Ch0. This can be represented by the two dimensional permutation matrix $$C_2 = \begin{bmatrix} 0 & 1 \\ 1 & 0 \end{bmatrix}$$

which when applied to a vector $$x = \begin{bmatrix} x_0 \\ x_1 \end{bmatrix}$$

where $x_0$ is a sample of Ch0 is and $x_1$ is a sample of Ch1, results in the vector $$\begin{bmatrix} x_1 \\ x_0 \end{bmatrix} = C_2 x$$

whose elements are permuted versions of the original vector.

Note that the inverse of a permutation matrix exists, is unique and is itself a permutation matrix. In fact, the inverse of a permutation matrix is its transpose. In other words, the inverse channel assignment of a channel assignment $c_N$ is the unique channel assignment d . . . $d_0$ $d_1$ . . . $d_{N-1}$] where $d_i$=j if $c_j$=i, so that $d_N$ when applied to the permuted channels restores the original order of channels.

As an example, consider the system 100 of FIG. 1A in which the encoder is given the 2*3 downmix specification:

$$A = \begin{bmatrix} 0.707 & 0.2903 & 0.9569 \\ 0.707 & 0.9569 & 0.2902 \end{bmatrix}$$

so that:

$$\begin{bmatrix} dmx0 \\ \\ dmx1 \end{bmatrix} = A \begin{bmatrix} ch0 \\ ch1 \\ ch2 \end{bmatrix}$$

where dmx0 and dmx1 are output channels from a decoder, and ch0, ch1, ch2 are the input channels (e.g., objects). In this case, the encoder may find three unit primitive matrices $P_0^{-1}$, $P_1^{-1}$, $P_2^{-1}$ (as shown below) and a given input channel assignment $d_3$=[2 0 1] which defines a permutation $D_3$ so that the product of the sequence is as follows:

$$\begin{bmatrix} 0.707 & 0.2903 & 0.9569 \\ 0.707 & 0.9569 & 0.2903 \\ 1 & -1.004 & 4.890 \end{bmatrix} = \underbrace{\begin{bmatrix} 1 & 0 & 0 \\ 1.666 & 1 & -0.4713 \\ 0 & 0 & 1 \end{bmatrix}}_{P_0^{-1}} \underbrace{\begin{bmatrix} 1 & -2.5 & 0.707 \\ 0 & 1 & 0 \\ 0 & 0 & 1 \end{bmatrix}}_{P_1^{-1}} \underbrace{\begin{bmatrix} 1 & 0 & 0 \\ 0 & 1 & 0 \\ -1.003 & 4.889 & 1 \end{bmatrix}}_{P_2^{-1}} \underbrace{\begin{bmatrix} 0 & 1 & 0 \\ 0 & 0 & 1 \\ 1 & 0 & 0 \end{bmatrix}}_{D_3}$$

As can be seen in the above example, the first two rows of the product are exactly the specified downmix matrix A. In other words if the sequence of these matrices is applied to the three input audio channels (ch0, ch1, ch2), the system produces three internal channels (ch0', ch1', ch2'), with the first two channels exactly the same as the 2-channel downmix desired. In this case the encoder could choose the output primitive matrices $Q_0$,$Q_1$ of the downmix substream as identity matrices, and the two-channel channel assignment (ChAssign0 in FIG. 1) as the identity assignment [0 1], i.e., the decoder would simply present the first two internal channels as the two channel downmix. It would apply the inverse of the primitive matrices $P_0^{-1}$, $P_1^{-1}$, $P_2^{-1}$ given by $P_0$, $P_1$, $P_2$ to (ch0', ch1', ch2') and then the inverse of the channel assignment $d_3$ given by $c_3$=[1 2 0] to obtain the original input audio channels (ch0, ch1, ch2). This example represents first decomposition method, referred to as "decomposition 1."

In a different decomposition, referred to as "decomposition 2," the system may use two unit primitive matrices $P_0^{-1}$, $P_1^{-1}$ (shown below) and an input channel assignment $d_3$=[2 1 0] which defines a permutation $D_3$ so that the product of the sequence is as follows:

$$\begin{bmatrix} 0.7388 & 0.3034 & 1 \\ 0.8137 & 1.1013 & 0.3340 \\ 1 & 0 & 0 \end{bmatrix} = \underbrace{\begin{bmatrix} 1 & 0 & 0 \\ 0.3340 & 1 & 0.5669 \\ 0 & 0 & 1 \end{bmatrix}}_{P_0^{-1}} \underbrace{\begin{bmatrix} 1 & 0.3034 & 0.7388 \\ 0 & 1 & 0 \\ 0 & 0 & 1 \end{bmatrix}}_{P_1^{-1}} \underbrace{\begin{bmatrix} 0 & 0 & 1 \\ 0 & 1 & 0 \\ 1 & 0 & 0 \end{bmatrix}}_{D_3}$$

In this case, note that the required specification A can be achieved by multiplying the first two rows of the above sequence with the output primitive matrices for the two channel substream chosen as $Q_0$, $Q_1$ below:

$$\begin{bmatrix} 0.707 & 0.2903 & 0.9569 \\ 0.707 & 0.9569 & 0.2902 \end{bmatrix} = \underbrace{\begin{bmatrix} 1 & 0 \\ 0 & 0.8689 \end{bmatrix}}_{Q_1} \underbrace{\begin{bmatrix} 0.9569 & 0 \\ 0 & 1 \end{bmatrix}}_{Q_0} \begin{bmatrix} 0.7388 & 0.3034 & 1 \\ 0.8137 & 1.1013 & 0.3340 \end{bmatrix}$$

Unlike in the original decomposition 1, the encoder achieves the required downmix specification by designing a combination of both input and output primitive matrices. The encoder applies the input primitive matrices (and channel assignment $d_3$) to the input audio channels to create a set of internal channels that are transmitted in the bitstream. At the decoder, the internal channels are reconstructed and output matrices $Q_0$, $Q_1$ are applied to get the required downmix audio. If the lossless original audio is needed the inverse of the primitive matrices $P_0^{-1}$, $P_1^{-1}$ given by $P_0$, $P_1$ are applied to the internal channels and then the inverse of the channel assignment $d_3$ given by $\in_3$=[2 1 0] to obtain the original input audio channels.

In both the first and second decompositions described above, the system has not employed the flexibility of using output channel assignment for the downmix substream, which is another degree of freedom that could have been exploited in the decomposition of the required specification A. Thus, different decomposition strategies can be used to achieve the same specification A.

Aspects of the above-described primitive matrix technique can be used to mix (upmix or downmix) TrueHD content for rendering in different listening environments. Embodiments are directed to systems and methods that enable the transmission of adaptive audio content via TrueHD, with a substream structure that supports decoding some standard downmixes such as 2ch, 5.1ch, 7.1ch by legacy devices, while support for decoding lossless adaptive audio may be available only in new decoding devices.

It should be noted that a legacy device as any device that decodes the downmix presentations already embedded in TrueHD instead of decoding the lossless objects and then re-rendering them to the required downmix configuration. The device may in fact be an older device that is unable to decode the lossless objects or it may be a device that consciously chooses to decode the downmix presentations. Legacy devices may have been typically designed to receive content in older or legacy audio formats. In the case of Dolby TrueHD, legacy content may be characterized by well-structured time-invariant downmix matrices with at most eight input channels, for instance, a standard 7.1ch to 5.1ch downmix matrix. In such a case, the matrix decomposition is static and needs to be determined only once by the encoder for the entire audio signal. On the other hand adaptive audio content is often characterized by continuously varying downmix matrices that may also be quite arbitrary, and the number of input channels/objects is generally larger, e.g., up to 16 in the Atmos version of Dolby TrueHD. Thus a static decomposition of the downmix matrix typically does not suffice to represent adaptive audio in a TrueHD format. Certain embodiments cover the decomposition of a given downmix matrix into primitive matrices as required by the TrueHD format.

Figure 2:
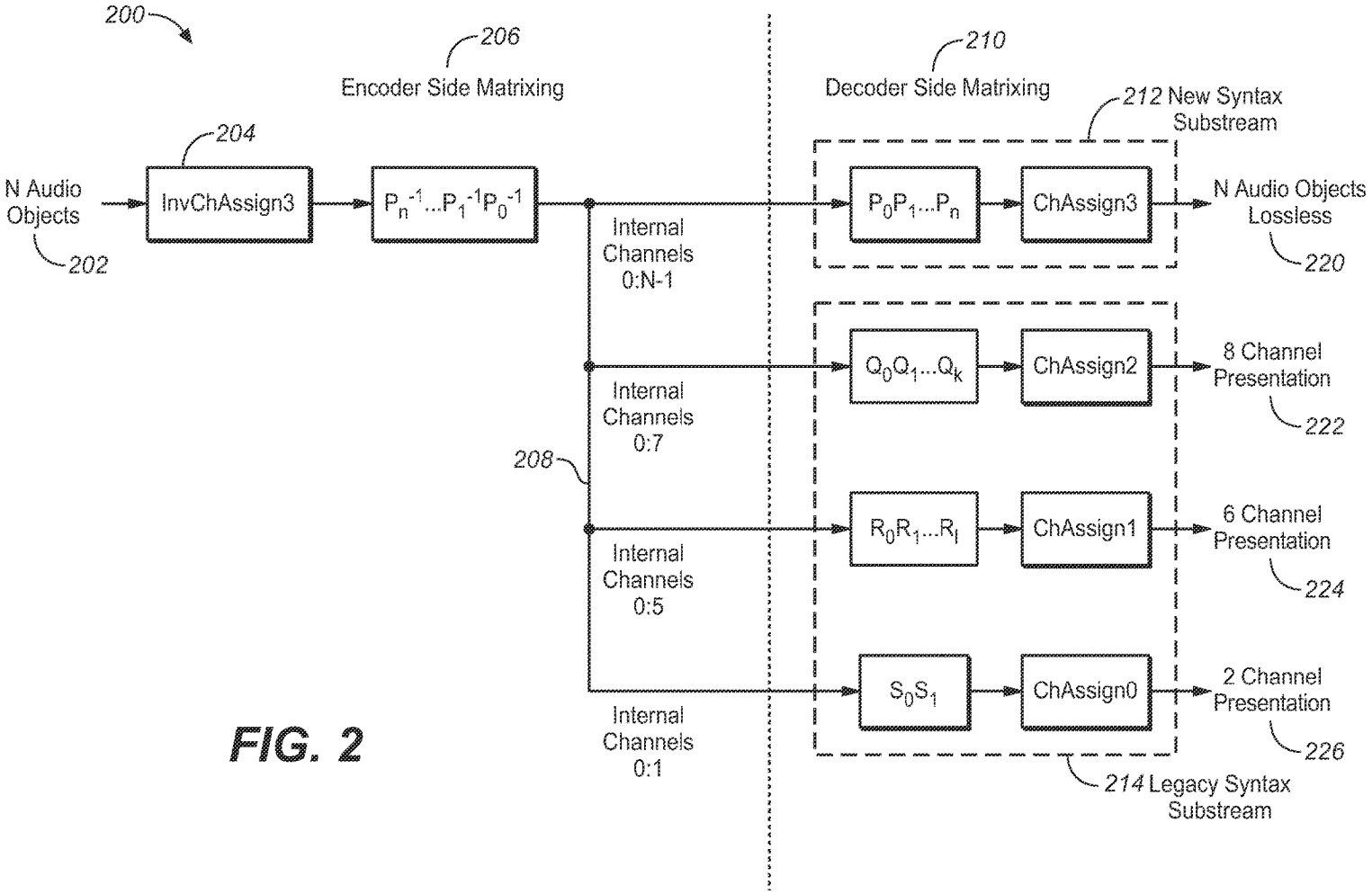
FIG. 2 illustrates a system that mixes N channels of adaptive audio content into a TrueHD bitstream, under some embodiments.

FIG. 2 illustrates a system that mixes N channels of adaptive audio content into a TrueHD bitstream, under some embodiments. FIG. 2 illustrates encoder-side 206 and decoder-side 210 matrixing of a TrueHD stream containing four substreams, three resulting in downmixes decodable by legacy decoders and one for reproducing the lossless original decodable by newer decoders.

In system 200, the N input audio objects 202 are subject to an encoder-side matrixing process 206 that includes an input channel assignment process 204 (invchassign3, inverse channel assignment 3) and input primitive matrices $P_n^{-1}, \ldots, P_1^{-1}, P_0^{-1}$. This generates internal channels 208 that are coded in the bitstream. The internal channels 208 are then input to a decoder side matrixing process 210 that includes substreams 212 and 214 that include output primitive matrices and output channel assignments (chAssign0-3) to produce the output channels 220-226 in each of the different downmix (or upmix) presentations.

As shown in system 200, a number N of audio objects 202 for adaptive audio content are matrixed 206 in the encoder to generate internal channels 208 in four substreams from which the following downmixes may be derived by legacy devices: (a) 8 ch (i.e., 7.1ch) downmix 222 of the original content, (b) 6ch (i.e., 5.1 ch) downmix 224 of (a), and (c) 2ch downmix 226 of (b). For the example of FIG. 2, the 8ch, 6ch, and 2ch presentations are required to be decoded by legacy devices, the output matrices $S_0$, $S_1$, $R_0, \ldots, R_l$, and $Q_0, \ldots, Q_k$ need to be in a format that can be decoded by legacy devices. Thus, the substreams 214 for these presentations are coded according to a legacy syntax. On the other hand the matrices $P_0, \ldots, P_n$ of substream 212 required to generate lossless reconstruction 220 of the input audio, and applied as their inverses in the encoder may be in a new format that may be decoded only by new TrueHD decoders. Also amongst the internal channels it may be required that the first eight channels that are used by legacy devices be encoded adhering to constraints of legacy devices, while the remaining N−8 internal channels may be encoded with more flexibility since they are only accessed by new decoders.

As shown in FIG. 2, substream 212 may be encoded in a new syntax for new decoders, while substreams 214 may be encoded in a legacy syntax for corresponding legacy decoders. As an example, for the legacy substream syntax, the primitive matrices may be constrained to have a maximum coefficient of 2, update in steps, i.e., cannot be interpolated, and matrix parameters, such as which channels the primitive matrices operate on may have to be sent every time the matrix coefficients update. The representation of internal channels may be through a 24-bit datapath. For the adaptive audio substream syntax (new syntax), the primitive matrices may be have a larger range of matrix coefficients (maximum coefficient of 128), continuous variation via specification of interpolation slope between updates, and syntax restructuring for efficient transmission of matrix parameters. The representation of internal channels may be through a 32-bit datapath. Other syntax definitions and parameters are also possible depending on the constraints and requirements of the system.

As described above, the matrix that transforms/downmixes a set of adaptive audio objects to a fixed speaker layout such as 7.1 (or other legacy surround format) is a dynamic matrix such as A(t) that continuously changes in time. However, legacy TrueHD generally only allows updating matrices at regular intervals in time. In the above example the output (decoder-side) matrices 210 $S_0$, $S_1$, $R_0, \ldots, R_l$, and $Q_0, \ldots, Q_k$ could possibly only be updated intermittently and cannot vary instantaneously. Further, it is desirable to not send matrix updates too often, since this side-information incurs significant additional data. It is instead preferable to interpolate between matrix updates to approximate a continuous path. There is no provision for this interpolation in some legacy formats (e.g., TrueHD), however, it can be accommodated in the bitstream syntax compatible with new TrueHD decoders. Thus, in FIG. 2, the matrices $P_0, \ldots, P_n$, and hence their inverses $P_0^{-1} \ldots, P_n^{-1}$ applied at the encoder could be interpolated over time. The sequence of the interpolated input matrices 206 at the encoder and the non-interpolated output matrices 210 in the downmix substreams would then achieve a continuously time-varying downmix specification A(t) or a close approximation thereof.

Figure 3:
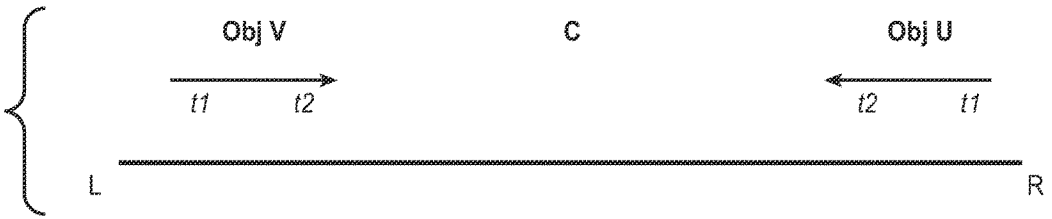
FIG. 3 is an example of dynamic objects for use in an interpolated matrixing scheme, under an embodiment.

FIG. 3 is an example of dynamic objects for use in an interpolated matrixing scheme, under an embodiment. FIG. 3 illustrates two objects Obj V and Obj U, and a bed C rendered to stereo (L, R). The two objects are dynamic and move from respective first locations at time t1 to respective second locations at time t2.

In general, an object channel of an object-based audio is indicative of a sequence of samples indicative of an audio object, and the program typically includes a sequence of spatial position metadata values indicative of object position or trajectory for each object channel. In typical embodiments of the invention, sequences of position metadata values corresponding to object channels of a program are used to determine an M×N matrix A(t) indicative of a time-varying gain specification for the program. Rendering N objects to M speakers at time t can be represented by multiplication of a vector x(t) of length "N", comprised of an audio sample at time "t" from each channel, by an M×N matrix A(t) determined from associated position metadata (and optionally other metadata corresponding to the audio content to be rendered, e.g., object gains) at time t. The resultant values (e.g., gains or levels) of the speaker feeds at time t can be represented as a vector y(t)=A(t)*x(t).

In an example of time-variant object processing, consider the system illustrated in FIG. 1 as having three adaptive audio objects as the three channel input audio. In this case, the two-channel downmix is required to be a legacy compatible downmix (i.e., stereo 2ch). A downmix/rendering matrix for the objects of FIG. 3 may be expressed as:

$$A(t) = \begin{bmatrix} 0.707 & \sin(vt) & \cos(vt) \\ 0.707 & \cos(vt) & \sin(vt) \end{bmatrix}$$

In this matrix, the first column may correspond to the gains of the bed channel (e.g., center channel, C) that feeds equally into the L and R channels. The second and third columns then correspond to the U and V object channels. The first row corresponds to the L channel of the 2ch downmix and the second row corresponds to the R channel, and the objects are moving towards each other at a speed, as shown in FIG. 3. At time tithe adaptive audio to 2ch downmix specification may be given by:

$$A(t1) = \begin{bmatrix} 0.707 & 0.2903 & 0.9569 \\ 0.707 & 0.9569 & 0.2902 \end{bmatrix}$$

For this specification by choosing input primitive matrices as described above for the decomposition 1 method, the output matrices of the two channel substream can be identity matrices. As the objects move around, from t1 to t2 (e.g., 15 access units later or 15*T samples, where T is the length of an access unit) the adaptive audio to 2ch specification evolves into:

$$A(t2) = \begin{bmatrix} 0.707 & 0.5556 & 0.8315 \\ 0.707 & 0.8315 & 0.5556 \end{bmatrix}$$

In this case, the input primitive matrices are given as:

$$\begin{bmatrix} 0.707 & 0.5556 & 0.8315 \\ 0.707 & 0.8315 & 0.5556 \\ 1 & -0.628 & 7.717 \end{bmatrix} = \underbrace{\begin{bmatrix} 1 & 0 & 0 \\ 1.2759 & 1 & -0.1950 \\ 0 & 0 & 1 \end{bmatrix}}_{Pnew_0^{-1}}$$

$$\underbrace{\begin{bmatrix} 1 & -4.624 & 0.707 \\ 0 & 1 & 0 \\ 0 & 0 & 1 \end{bmatrix}}_{Pnew_1^{-1}} \underbrace{\begin{bmatrix} 1 & 0 & 0 \\ 0 & 1 & 0 \\ -0.628 & 7.717 & 1 \end{bmatrix}}_{Pnew_2^{-1}} \underbrace{\begin{bmatrix} 0 & 1 & 0 \\ 0 & 0 & 1 \\ 1 & 0 & 0 \end{bmatrix}}_{D_3}$$

So that the first two rows of the sequence are the required specification. The system can thus continue using identity output matrices in the two-channel substream even at time t2. Additionally note that the pairs of unit primitive matrices ($P_0$, $Pnew_0$), ($P_1$, $Pnew_1$), and ($P_2$, $Pnew_2$) operate on the same channels, i.e., they have the same rows to be non-trivial. Thus one could compute the difference or delta between these primitive matrices as the rate of change per access unit of the primitive matrices in the lossless substream as:

$$\Delta_0 = \frac{Pnew_0 - P_0}{15} = \begin{bmatrix} 0 & 0 & 0 \\ 0.0261 & 0 & -0.0184 \\ 0 & 0 & 0 \end{bmatrix}$$

$$\Delta_1 = \frac{Pnew_1 - P_1}{15} = \begin{bmatrix} 0 & 0.1416 & 0 \\ 0 & 0 & 0 \\ 0 & 0 & 0 \end{bmatrix}$$

$$\Delta_2 = \frac{Pnew_2 - P_2}{15} = \begin{bmatrix} 0 & 0 & 0 \\ 0 & 0 & 0 \\ -0.0250 & -0.01885 & 0 \end{bmatrix}$$

An audio program rendering system (e.g., a decoder implementing such a system) may receive metadata which determine rendering matrices A(t) (or it may receive the matrices themselves) only intermittently and not at every instant t during a program. For example, this could be due to any of a variety of reasons, e.g., low time resolution of the system that actually outputs the metadata or the need to limit the bit rate of transmission of the program. It is therefore desirable for a rendering system to interpolate between rendering matrices A(t1) and A(t2) at time instants t1 and t2, respectively, to obtain a rendering matrix A(t') for an intermediate time instant t'. Interpolation generally ensures that the perceived position of objects in the rendered speaker feeds varies smoothly over time, and may eliminate undesirable artifacts that stem from discontinuous (piece-wise constant) matrix updates. The interpolation may be linear (or nonlinear), and typically should ensure a continuous path from A(t1) to A(t2).

In an embodiment, the primitive matrices applied by the encoder at any intermediate time-instant between t1 and t2 are derived by interpolation. Since the output matrices of the downmix substream are held constant, as identity matrices, the achieved downmix equations at a given time tin between t1 and t2 can be derived as the first two rows of the product:

$$\left(P_0^{-1} - \Delta_0 * \frac{t - t1}{T}\right)\left(P_1^{-1} - \Delta_1 * \frac{t - t1}{T}\right)\left(P_2^{-1}(t1) - \Delta_2 * \frac{t - t1}{T}\right)D_3$$

Thus a time-varying specification is achieved while not interpolating the output matrices of the two-channel substream but only interpolating the primitive matrices of the lossless substream that corresponds to the adaptive audio presentation. This is achieved because the specifications A(t1) and A(t2) were decomposed into a set of input primitive matrices that when multiplied contained the required specification as a subset of the rows, and hence allowed the output matrices of the downmix substreams to be constant identity matrices.

In an embodiment, the matrix decomposition method includes an algorithm to decompose an M*N matrix (such as the 2*3 specification A(t1) or A(t2)) into a sequence of N*N primitive matrices (such as the 3*3 primitive matrices $P_0^{-1}$, $P_1^{-1}$, $P_2^{-1}$, or $Pnew_0^{-1}$, $Pnew_1^{-1}$, $Pnew_2^{-1}$ in the above example) and a channel assignment (such as $d_3$) such that the product of the sequence of the channel assignment and the primitive matrices contains in it M rows that are substantially close to or exactly the same as the specified matrix. In general, this decomposition algorithm allows the output matrices to be held constant. However, it forms a valid decomposition strategy even if that were not the case.

In an embodiment, the matrix decomposition scheme involves a matrix rotation mechanism. As an example, consider the 2*2 matrix Z which will be referred to as a "rotation":

$$Z = \begin{bmatrix} -0.4424 & -0.4424 \\ -1.0607 & 1.0607 \end{bmatrix}$$

The system constructs two new specifications B(t1) and B(t2) by applying the rotation Z on A(t1) and A(t2):

$$B(t1) = Z * A(t1) = \begin{bmatrix} -0.6255 & -0.5517 & -0.5517 \\ 0 & 0.7071 & -0.7071 \end{bmatrix}$$

The 12-norm (root square sum of elements) of the rows of B(t1) is unity, and the dot product of the two rows is zero. Thus, if one designs input primitive matrices and channel assignment to achieve the specification B(t1) exactly, then application of the so designed primitive matrices and channel assignments to the input audio channels (ch0, ch1, ch2) will result in two internal channels (ch0', ch1') that are not too large, i.e., the power is bounded. Further, the two internal channels (ch0', ch1') are likely to be largely uncorrelated, if the input channels were largely uncorrelated to begin with, which is typically the case with object audio. This results in improved compression of the internal channels into the bitstream. Similarly:

$$B(t2) = Z * A(t2) = \begin{bmatrix} -0.6255 & -0.6136 & -0.6136 \\ 0 & 0.2927 & -0.2926 \end{bmatrix}$$

In this case the rows are orthogonal to each other, however the rows are not of unit norm. Again the input primitive matrices and channel assignment can be designed using an embodiment described above in which an M*N matrix is decomposed into a sequence of N*N primitive matrices and a channel assignment to generate primitive matrices containing M rows that are exactly or nearly exactly the specified matrix.

However, it is desired that the achieved downmix correspond to the specification A(t1) at time t1 and A(t2) at time t2. Thus, deriving the two-channel downmix from the two internal channels (ch0', ch1') requires a multiplication by $Z^{-1}$. This could be achieved by designing the output matrices as follows:

$$Z^{-1} = \begin{bmatrix} -1.1303 & -0.4714 \\ -1.1303 & 0.4714 \end{bmatrix} = \underbrace{\begin{bmatrix} -0.8847 & -0.4170 \\ 0 & 1 \end{bmatrix}}_{Q_1} \underbrace{\begin{bmatrix} 1 & 0 \\ -1.0607 & 1.0607 \end{bmatrix}}_{Q_0}$$

Since the same rotation Z was applied at both instants of time, the same output matrices $Q_0$, $Q_1$ can be applied by the decoder to the internal channels at times t1 and t2 to get the required specifications A(t1) and A(t2), respectively. So, the output matrices have been held constant (although they are not identity matrices any more), and there is an added advantage of improved compression and internal channel limiting in comparison with other embodiments.

As a further example, consider a sequence of downmixes as required in the four substream example of FIG. 2. Let the 7.1 ch to 5.1 ch downmix matrix be as follows:

$$A_1 = \begin{bmatrix} 1 & 0 & 0 & 0 & 0 & 0 & 0 & 0 \\ 0 & 1 & 0 & 0 & 0 & 0 & 0 & 0 \\ 0 & 0 & 1 & 0 & 0 & 0 & 0 & 0 \\ 0 & 0 & 0 & 1 & 0 & 0 & 0 & 0 \\ 0 & 0 & 0 & 0 & 0.707 & 0 & 0.707 & 0 \\ 0 & 0 & 0 & 0 & 0 & 0.707 & 0 & 0.707 \end{bmatrix}$$

and the 5.1 ch to 2ch downmix matrix be the well-known matrix:

$$A_2 = \begin{bmatrix} 1 & 0 & 0.707 & 0 & 0.707 & 0 \\ 0 & 1 & 0.707 & 0 & 0 & 0.707 \end{bmatrix}$$

In this case, a rotation Z to be applied to A(t), the time-varying adaptive audio-to-8 ch downmix matrix, can be defined as:

$$Z = \begin{bmatrix} 1 & 0 & 0.707 & 0 & 0.5 & 0 & 0.5 & 0 \\ 0 & 1 & 0.707 & 0 & 0 & 0.5 & 0 & 0.5 \\ 0 & 0 & 1 & 0 & 0 & 0 & 0 & 0 \\ 0 & 0 & 0 & 1 & 0 & 0 & 0 & 0 \\ 0 & 0 & 0 & 0 & 0.707 & 0 & 0.707 & 0 \\ 0 & 0 & 0 & 0 & 0 & 0.707 & 0 & 0.707 \\ 0 & 0 & 0 & 0 & 0 & 0 & 1 & 0 \\ 0 & 0 & 0 & 0 & 0 & 0 & 0 & 1 \end{bmatrix}$$

The first two rows of Z form the sequence of $A_2$ and $A_1$. The next four rows form the last four rows of $A_1$. The last two rows have been picked as identity rows since they make Z full rank and invertible.

It can be shown that whenever Z*A(t) is full rank [1] (rank=8), if the input primitive matrices and channel assignment are designed using the first aspect of the invention so that Z*A(t) is contained in the first 8 rows of the decomposition, then:

(a) The first two internal channels form exactly the two channel presentation and the output matrices $S_0$, $S_1$ for substream 0 in FIG. 2 are simply identity matrices and hence constant over time (b) Further the six channel downmix can be obtained by applying constant (but not identity) output matrices $R_0, \ldots, R_l$.

(c) The eight channel downmix can be obtained by applying constant (but not identity) output matrices $Q_0, \ldots, Q_k$.

Thus, when employing such an embodiment to design input primitive matrices, the rotation Z helps to achieve the hierarchical structure of TrueHD. In certain cases, it may be desired to support a sequence of K downmixes specified by a sequence of downmix matrices (going from top to bottom) $A_0$ of dimension $M_0 \times N$, $A_1$ of dimension $M_1 \times M_0, \ldots A_k$ of dimension $M_k \times M_{k-1}, \ldots k<K$. In other words, the system is able to support the following hierarchy of linear transformations of the input audio in a single TrueHD bitstream: $A_0$, $A_1 \times A_0, \ldots A_k \times A_1 \times A_0$, $k<K$, where $A_0$ is the topmost downmix that is of dimension $M_0 \times N$.

In an embodiment, the matrix decomposition method includes an algorithm to design an $L \times M_0$ rotation matrix Z that is to be applied to the top-most downmix specification $A_0$ so that: (1) The $M_k$ channel downmix (for $i \ldots \{0, 1, \ldots, K-1\}$) can be obtained by a linear combination of the smaller of $M_k$ or L rows of the $L \times N$ rotated specification $Z^*A_0$, and one or more of the following may additionally be achieved: rows of the rotated specification have low correlation; rows of the rotated specification have small norms/limits the power of internal channels; the rotated specification on decomposition into primitive matrices results in small coefficient/coefficients that can be represented within the constraints of the TrueHD bitstream syntax; the rotated specification enables a decomposition into input primitive matrices and output primitive matrices such that the overall error between the required specification and achieved specification (the sequence of the designed matrices) is small; and the same rotation when applied to consecutive matrix specifications in time, may lead to small differences between primitive matrices at the different time instants.

One or more embodiments of the matrix decomposition method are implemented through one or more algorithms executed on a processor-based computer. A first algorithm or set of algorithms may implement the decomposition of an M*N matrix into a sequence of N*N primitive matrices and a channel assignment, also referred to as the first aspect of the matrix decomposition method, and a second algorithm or set of algorithms may implement designing a rotation matrix Z that is to be applied to the topmost downmix specification in a sequence of downmixes specified by a sequence of downmix matrices, also referred to as the second aspect of the matrix decomposition method.

For the below-described algorithm(s), the following preliminaries and notation are provided. For any number x we define:

$$\mathrm{abs}(x) = \begin{cases} x & x \geq 0 \\ -x & x < 0 \end{cases}$$

For any vector $x=[x_0 \ldots x_m]$ we define:

$\mathrm{abs}(x)=[\mathrm{abs}(x_0) \ldots \mathrm{abs}(x_m)]$ $$\mathrm{sum}(x) = \sum_{i=0}^{m} x_i$$

For any $M \times N$ matrix X, the rows of X are indexed top-to-bottom as 0 to M−1, and the columns left-to-right as 0 to N−1, and denote by $x_{ij}$ the element of X in row i and column j.

$$X = \begin{bmatrix} x_{00} & x_{01} & \cdots & \cdots & x_{0N-1} \\ x_{10} & x_{11} & \cdots & \cdots & x_{1N-1} \\ \vdots & \vdots & \vdots & & \vdots \\ \vdots & \vdots & & \vdots & \vdots \\ x_{M-10} & x_{M-11} & & & x_{M-1N-1} \end{bmatrix}$$

The transpose of X is indicated as $X^T$. Let $u=[u_0\ u_1 \ldots u_{l-1}]$ be a vector of l indices picked from 0 to M−1, and $v=[v_0 \ldots v_{k-1}]$ be a vector of k indices picked from 0 to N−1. X(u, v) denotes the $l \times k$ matrix Y whose element $y_{ij}=x_{u_i v_j}$, i.e., Y or X(u, v) is the matrix formed by selecting from X rows with indices given by u and columns with indices given by V.

If M=N, the determinant [1] of X can be calculated and is denoted as det(X). The rank of the matrix X is denoted as rank(X), and is less than or equal to the smaller of M and N. Given a vector x of N elements and a channel index c, a primitive matrix P that manipulates channel c is constructed by prim(x,c) that replaces row c of an $N \times N$ identity matrix with x.

In an embodiment, an algorithm (Algorithm 1) for the first aspect is provided as follows: Let Abe an $M \times N$ matrix with $M<=N$ and let rank(A)=M, i.e., A is full rank. The algorithm determines unit primitive matrices $P_0, P_1, \ldots, P_n$ of dimension $N \times N$ and a channel assignment $d_N$ so that the product: $P_n \times \ldots \times P_1 \times P_0 \times D_N$, where $D_N$ is the permutation matrix corresponding to $d_N$, contains in it M rows matching the rows of A.

(A) Initialize: $f = [0\ \ 0\ \ \ldots\ \ 0]_{1\times M}$, $e = \{0, 1, \ldots, N-1\}$, $B = A$, $\underline{P} = \{\ \}$ (B) Determine unit primitive matrices:

while(sum(f) < M){

(1) r = [ ], c = [ ], t = 0;

(2) Determine rowsToLoopOver (3) Determine row group r and corresponding columns/channels c :

for (r in rowsToLoopOver)

{

(a) $$c_{best} = \max_{c \in e, c \notin c} \mathrm{abs}(\det(B([r\ \ r], [c\ \ c])))$$

-continued

```
            (b) if abs(det (B([r  r], [c  c_best]))) > 0
            {
                (i) if r is an empty vector and abs(det (B([r  r], [c  c_best]))) == 1, t = 1
                (ii) f_r = 1, (f_r is element r in f)
                (iii) r = [r  r], c = [c  c_best]
            }
            (c) if t = 1 break;
        }
    (4) Determine unit primitive matrices for row group:
        (a) if t = 1, P_0' = prim (B(r, [0  ...  N − 1])), P' = {P_0'};
        (b) else
            {
                (i) Select one more column/channel c_last ∈ e, c_last ∉ c and append: c = [c  c_last]
                (ii) Decompose row group r in B given column selection c via the Algorithm 2
                     below to get a set of unit primitive matrices P'
            }
    (5) Add new unit primitive matrices to existing set: P = {P'; P}
    (6) Account for primitive matrices: B = A × P_0^-1 × P_1^-1:  ...·× P_l^-1 where P is the sequence
        P = {P_l  ... ; P_0}
    (7) If t = 0, c = [c_1  ...·].
    (8) Remove the elements in c from e
}
(C) Determine channel assignment:
    (1) Set B = P_n''  ... × P_1 × P_0, where P is the sequence P = {P_n  ... ; P_0}.
    (2) e = {0, 1,  ... , N − 1}, c_N = [ ]
    (3) For (r in 0,  ... M − 1)
        {
            (i) Identify row r' in B that is same as/very close to row r in A
            (ii) c_N = [c_N  r']
            (iii) Remove r' from e
        }
    (4) Append elements of e to c_N in order to make the latter a vector of N elements.
        Determine the permutation d_N that is the inverse of c_N, and the corresponding
        permutation matrix D_N.
    (5) Account for channel assignment: P_i = D_N × P_i × D_N^-1, P_i ∈ P
```

In an embodiment, an algorithm (denoted Algorithm 2) is provided as shown below. This algorithm continues from step B.4.b.ii in Algorithm 1. Given matrix B, row selection r and column selection C:

(A) Complete C to be a vector of N elements by appending to it elements in $\{0, 1, \ldots, N-1\}$ not already in it.

(B) Set $$G = \begin{bmatrix} 1 & 0 & \ldots & 0 \\ & B(r, c) & & \end{bmatrix}$$

(C) Find l+1 unit primitive matrices $P_0', P_1', \ldots P_l'$, where l is the length of r and row i of $P_i'$ is the non-trivial row of the primitive matrix, such that rows 1 to l of the sequence $P_l' \times \ldots \times P_1' \times P_0'$ match rows 1 to l of G. This is a constructive procedure, which is shown for an example matrix below (D) Construct permutation matrix $C_N$ corresponding to c and set $P_i' = C_N^{-1} \times P_i' \times C_N$ (E) $\underline{P}'\{P_l' \ldots ; P_1'; P_0'\}$;

An example for step (c) in algorithm 2 is given as follows:

$$G = \begin{pmatrix} 1 & 0 & 0 \\ g_{1,0} & g_{1,1} & g_{1,2} \\ g_{2,0} & g_{2,1} & g_{2,2} \end{pmatrix}.$$

Here, l=2. We want to decompose this into three primitive matrices:

$$P_2 = \begin{pmatrix} 1 & 0 & 0 \\ 0 & 1 & 0 \\ p_{2,0} & p_{2,1} & 1 \end{pmatrix}, P_1 = \begin{pmatrix} 1 & 0 & 0 \\ p_{1,0} & 1 & p_{1,2} \\ 0 & 0 & 1 \end{pmatrix}, P_0 = \begin{pmatrix} 1 & p_{0,1} & p_{0,2} \\ 0 & 1 & 0 \\ 0 & 0 & 1 \end{pmatrix}$$

Such that:

$$P_2 P_1 P_0 = \begin{pmatrix} 1 & p_{0,1} & p_{0,2} \\ g_{1,0} & g_{1,1} & g_{1,2} \\ g_{2,0} & g_{2,1} & g_{2,2} \end{pmatrix}$$

Since multiplication pre-multiplication by $P_2$ only affects the third row, $$\begin{pmatrix} 1 & 0 & 0 \\ p_{1,0} & 1 & p_{1,2} \\ 0 & 0 & 1 \end{pmatrix} \begin{pmatrix} 1 & p_{0,1} & p_{0,2} \\ 0 & 1 & 0 \\ 0 & 0 & 1 \end{pmatrix} = \begin{pmatrix} 1 & p_{0,1} & p_{0,2} \\ g_{1,0} & g_{1,1} & g_{1,2} \\ 0 & 0 & 1 \end{pmatrix}$$

Which requires that $p_{1,0}=g_{1,0}$ and $p_{0,1}=(g_{1,1}-1)/g_{1,0}$ as above. $p_{0,2}$ is not yet constrained, whatever value it takes can be compensated for by altering $p_{1,2}=g_{1,2}-p_{1,0}p_{0,2}$.

For the row 2 primitive matrix, our starting point is that we require $$P_2 P_1 P_0 = \begin{pmatrix} 1 & 0 & 0 \\ 0 & 1 & 0 \\ p_{2,0} & p_{2,1} & 1 \end{pmatrix} \begin{pmatrix} 1 & p_{0,1} & p_{0,2} \\ g_{1,0} & g_{1,1} & g_{1,2} \\ 0 & 0 & 1 \end{pmatrix} = \begin{pmatrix} 1 & p_{0,1} & p_{0,2} \\ g_{1,0} & g_{1,1} & g_{1,2} \\ g_{2,0} & g_{2,1} & g_{2,2} \end{pmatrix}$$

Looking at $p_{2,0}$ & $p_{2,1}$ we have the simultaneous equations $$(p_{2,0} \quad p_{2,1})\begin{pmatrix} 1 & p_{0,1} \\ g_{1,0} & g_{1,1} \end{pmatrix} = (g_{2,0} \quad g_{2,1})$$

Now we know this is soluble because $$\begin{vmatrix} 1 & p_{0,1} \\ g_{1,0} & g_{1,1} \end{vmatrix} = |P_1 P_0| = 1.$$

And now $p_{0,2}$ is defined by $$g_{2,2}=p_{2,0}p_{0,2}+p_{2,1}g_{1,2}+1$$

Which will exist so long as $p_{2,0}$ doesn't vanish.

With regard to Algorithm 1, in practical application there is a maximum coefficient value that can be represented in the TrueHD bitstream and it is necessary to ensure that the absolute value of coefficients are smaller than this threshold. The primary purpose of finding the best channel/column in step B.3.a of Algorithm 1 is to ensure that the coefficients in the primitive matrices are not large. In another variation of Algorithm 1, rather than compare the determinant in Step B.3.b to 0, one may compare it to a positive non-zero threshold to ensure that the coefficients will be explicitly constrained according to the bitstream syntax. In general smaller the determinant computed in Step B.3.b larger the eventual primitive matrix coefficients—so lower bounding the determinant, upper bounds the absolute value of the coefficients.

In step B.2 the order of rows handled in the loop of step B.3 given by rowsToLoopOver is determined. This could simply be the rows that have not yet been achieved as indicated by the flag vector f ordered in ascending order of indices. In another variation of Algorithm 1, this could be the rows ordered in ascending order of the overall number of times they have been tried in the loop of step B.3, so that the ones that have been tried least will receive preference.

In step B.4.b.i of Algorithm 1 an additional column $c_{last}$ is to be chosen. This could be arbitrarily chosen, while adhering to the constraint that $c_{last} \in e$, $c_{last} \notin c$. Alternatively, one may consciously choose $c_{last}$ so as to not use up a column that may be most beneficial for decomposition of rows in a subsequent iteration. This could be done by tracking the costs for using different columns as computed in Step. B.3.a of Algorithm 1.

Note that Step. B.3 of Algorithm 1 determines the best column for one row and moves on to the next row. In another variation of Algorithm 1, one may replace Step B.2 and Step B.3 with a nested pair of loops running over both rows yet to be achieved and columns still available so that an optimal (minimizing the value of primitive matrix coefficients) ordering of both rows and columns can be determined simultaneously.

While Algorithm 1 was described in the context of a full rank matrix whose rank is M, it can be modified to work with a rank deficient matrix whose rank is L<M. Since the product of unit primitive matrices is always full rank, we can expect only to achieve L rows of A in that case. An appropriate exit condition will be required in the loop of Step B to ensure that once L linearly independent rows of A are achieved the algorithm exits. The same work-around will also be applicable if M>N.

The matrix received by Algorithm 1 may be a downmix specification that has been rotated by a suitably designed matrix Z. It is possible that during the execution of Algorithm 1 one may end up in a situation where the primitive matrix coefficients may grow larger than what can be represented in the TrueHD bitstream, which fact may not have been anticipated in the design of Z. In yet another variation of Algorithm 1 the rotation Z may be modified on the fly to ensure that the primitive matrices determined for the original downmix specification rotated by the modified Z behaves better as far as values of primitive matrix coefficients are concerned. This can be achieved by looking at the determinant calculated in Step B.3.b of Algorithm 1 and amplifying row r by suitable modification of Z, so that the determinant is larger than a suitable lower bound.

In Step C.4 of the algorithm one may arbitrarily choose elements in e to complete $c_N$ into a vector of N elements. In a variation of Algorithm 1 one may carefully choose this ordering so that the eventual (after Step C.5) sequence of primitive matrices and channel assignment $P_n \times \ldots \times P_1 \times P_0 \times D_N$ has rows with larger norms/large coefficients positioned towards the bottom of the matrix. This makes it more likely that on applying the sequence $P_n \times \ldots \times P_1 \times P_0 \times D_N$ to the input channels, larger internal channels are positioned at higher channel indices and hence encoded into higher substreams. Legacy TrueHD supports only a 24-bit datapath for internal channels while new TrueHD decoders support a larger 32-bit datapath. So pushing larger channels to higher substreams decodable only by new TrueHD decoders is desirable.

With regard to Algorithm 1, in practical application, suppose the application needs to support a sequence of K downmixes specified by a sequence of downmix matrices (going from top-to-bottom) as follows: $A_0 \rightarrow A_1 \rightarrow \ldots \rightarrow A_{K-1}$ where $A_0$ has dimension $M_0 \times N$, and $A_k$, k>0 has dimension $M_k \times M_{k-1}$. For instance, there may be given: (a) a time-varying 8×N specification $A_0=A(t)$ that downmixes N adaptive audio channels to 8 speaker positions of a 7.1ch layout, (b) a 6×8 static matrix $A_1$ that specifies a further downmix of the 7.1ch mix to a 5.1ch mix, or (c) a 2×6 static matrix $A_2$ that specifies a further downmix of the 5.1ch mix to a stereo mix. The method describes the design of an $L \times M_0$ rotation matrix Z that is to be applied to the top-most downmix specification $A_0$, before subjecting it to Algorithm 1 or a variation thereof.

In a first design (denoted Design 1), if the downmix specifications $A_k$, k>0, have rank $M_k$ then we can choose $L=M_0$ and Z may be constructed according to the following algorithm (denoted Algorithm 3):

(A) Initialize: L = 0, Z = [ ], c = [0 1 . . . N − 1]
(B) Construct:
for (k = K − 1 to 0)
{
(a) If k > 0 calculate the sequence for the $M_k$ channel downmix from the first downmix: $H_k = A_k \times A_{k-1} \times \ldots \times A_1$
(b) Else set $H_k$ to an identity matrix of dimension $M_k$
(c) Update Z: $r = [L \quad L+1 \quad \ldots \quad M_k - 1]$, $Z = \begin{bmatrix} Z \\ H_k(r, c) \end{bmatrix}$
(d) Update $L = M_k$
}

This design will ensure that the $M_k$ channel downmix (for $k \in \{0, 1, \ldots, K-1\}$) can be obtained by a linear combination of the smaller of $M_k$ or L rows of the L×N rotated specification $Z*A_0$. This algorithm was employed to design the rotation of an example case described above. The algorithm returns a rotation that is the identity matrix if the number of downmixes K is one.

A second design (denoted Design 2) may be used that employs the well-known singular value decomposition (SVD). Any M×N matrix X can be decomposed via SVD as X=U×S×V where U and V are orthonormal matrices of dimension M×M and N×N, respectively, and S is an M×N diagonal matrix. The diagonal matrix S is defined thus:

$$S = \begin{bmatrix} s_{00} & 0 & 0 & \dots & 0 & 0 \\ 0 & s_{11} & \vdots & & \vdots & 0 \\ 0 & & \vdots & & \vdots & \vdots \\ \vdots & \dots & \vdots & & & \vdots \\ \vdots & \dots & & s_{ii} & \dots & \\ 0 & 0 & 0 & \dots & \dots & \end{bmatrix}$$

In this matrix, the number of elements on the diagonal is the smaller of M or N. The values $s_i$ on the diagonal are non-negative and are referred to as the singular values of X. It is further assumed that the elements on the diagonal have been arranged in decreasing order of magnitude, i.e., $s_{00} \geq s_{11} \geq \dots$. Unlike in Design 1, the downmix specifications can be of arbitrary rank in this design. The matrix Z may be constructed according to the following algorithm (denoted Algorithm 4) as follows:

(A) Initialize: L = 0, Z = [ ], X = [ ], c = [0 1 . . . N −1]
(B) Construct:
for (k = K − 1 to 0)
{
(a) If k > 0 calculate the sequence for the $M_k$ channel downmix from the first downmix: $H_k = A_k \times A_{k-1} \times \dots \times A_1$
(b) Else set $H_k$ to an identity matrix of dimension $M_k$
(c) Calculate the sequence for the $M_k$ channel downmix from the input: $T_k = H_k \times A_0$
(d) If the basis set X is not empty:
{
(i) Calculate projection coefficients: $W_k = T_k \times X^T$
(ii) Compute matrix to decompose with prediction: $T_k = T_k - W_k \times X$
(iii) Account for prediction in rotation: $H_k = H_k - W_k \times Z$
}
(e) Decompose via SVD $T_k = USV$
(f) Find the largest i in {0, 1, . . . , min ($M_k$ − 1, N-1)} such that $s_{ii} > \theta$, where θ is a small positive threshold (say, 1/1024) used to define the rank of a matrix.
(g) Build the basis set: $X = \begin{bmatrix} X \\ V([0 \quad 1 \quad \dots \quad i], c) \end{bmatrix}$
(h) Get new rows for Z:

$$Z' = \begin{bmatrix} \frac{1}{s_{00}} & 0 & \dots & 0 \\ & & & \vdots \\ 0 & \frac{1}{s_{11}} & \vdots & \vdots \\ \vdots & & \vdots & \\ \vdots & \vdots & & 0 \\ & \vdots & & \\ 0 & \dots & 0 & \frac{1}{s_{ii}} \end{bmatrix} \times U^T([0 \quad \dots \quad i], [0 \quad \dots \quad M_k]) \times H_k$$

(i) Update $Z = \begin{bmatrix} Z \\ Z' \end{bmatrix}$
}
(C) L = number of rows in Z Note that the eventual rotated specification $Z^*A_0$ is substantially the same as the basis set X being built in Step. B.g of Algorithm 4. Since the rows of X are rows of an orthonormal matrix, the rotated matrix $Z^*A_0$ that is processed via Algorithm 1 will have rows of unit norm, and hence the internal channels produced by the application of primitive matrices so obtained will be bounded in power.

In an example above, Algorithm 4 was employed to find the rotation Z in an example above. In that case there was a single downmix specification, i.e.,
K=1, $M_0$=2, N=3, and the $M_0$×N specification was A(t1).

For a third design (Design 3), one could additionally multiply Z obtained via Design 1 or Design 2 above with a diagonal matrix W containing non-zero gains on the diagonal $$Z'' = \underbrace{\begin{bmatrix} w_0 & 0 & \dots & 0 \\ 0 & w_1 & \vdots & \vdots \\ \vdots & \dots & \vdots & 0 \\ 0 & \dots & 0 & w_{L-1} \end{bmatrix}}_{W}_{L \times L} \times Z, \quad w_0 > 0$$

The gains may be calculated so that $Z''^*A_0$ when decomposed via Algorithm 1 or one of its variants results in primitive matrices with coefficients that are small can be represented in the TrueHD syntax. For instance, one could examine the rows of $A'=Z^*A_0$ and set:

$$w_i = \frac{1}{\max \operatorname{abs}(A'(i, [0 \quad 1 \quad \ldots \quad N-1]))},$$

This would ensure that the maximum element in every row of the rotated matrix Z"*$A_0$ has an absolute value of unity, making the determinant computed in Step B.3.b of Algorithm 1 less likely to be close to zero. In another variation the gains $w_i$ are upper bounded, so that very large gains (which may occur when A' is approaching rank deficiency) are not allowed.

A further modification of this approach is to start off with $w_i$=1, and increase it (or even decrease it) as Algorithm 1 runs to ensure that the determinant in Step B.3.b of Algorithm 1 has a reasonable value, which in turn will result in smaller coefficients when the primitive matrices are determined in Step. B. 4 of Algorithm 1.

In an embodiment, the method may implement a rotation design to hold output matrices constant. In this case, consider the example of FIG. 2, in which the adaptive audio to 7.1ch specification is time-varying, while the specifications to downmix further are static. As discussed above, it may be beneficial to be able to maintain output primitive matrices of downmix substreams constant, since they may conform to the legacy TrueHD syntax. This can in turn be achieved by maintaining the rotation Z a constant. Since the specifications $A_1$ and $A_2$ are static, irrespective of what the adaptive audio-to-7.1ch specification A(t) is, Design 1/Algorithm 3 above will return the same rotation Z. However, as Algorithm 1 progresses with its decomposition of Z*A(t), the system may need to modify Z to Z" via W as described under Design 3 above. The diagonal gain matrix W may be time variant (i.e., dependent on A(t)), although Z itself is not. Thus, the eventual rotation Z" would be time-variant and will not lead to constant output matrices. In such a case it may be possible to look at several time instants t1, t2, . . . where A(t) may be specified, compute the diagonal gain matrix at each instant of time, and then construct an overall diagonal gain matrix W', for instance, by computing the maximum of gains across time. The constant rotation to be applied is then given by Z"=W'×Z.

Alternatively, one may design the rotation for an intermediate time-instant t between t1 and t2 using either Algorithm 3 or Algorithm 4, and then employ the same rotation at all times instants between t1 and t2. Assuming that the variation in specification A(t) is slow, such a procedure may still lead to very small errors between the required specification and the achieved specification (the sequence of the designed input and output primitive matrices) for the different sub streams despite holding the output primitive matrices are held constant.

Audio Segmentation

As described above, embodiments are directed to the segmentation of audio into restart intervals of potentially varying length while accounting for the downmix matrix trajectory. The above description illustrates a decomposition of the 2*3 downmix matrices A(t1) and A(t2) at time t1 and t2 such that the output matrices for the two channel substream can be identity matrices at both time instants. The input primitive matrices can be interpolated at the two time instants because the pairs of unit primitive matrices ($P_0$, $Pnew_0$), ($P_1$, $Pnew_1$), and ($P_2$, $Pnew_2$) operate on the same channels, i.e., they have the same rows to be non-trivial. These in turn defined the interpolation slope denoted as $\Delta_0$, $\Delta_1$, $\Delta_2$ respectively. The downmix matrix further evolve to A(t3), at a later time t3, where t3>t2. Assume that A(t3) could be decomposed such that:

(1) the output matrices are again identity matrices (and also the output channel assignment), (2) the same input channel assignment $d_3$ at time t1 and t2 also works at t3

(3) the new primitive matrices $Pnewer_0$, $Pnewer_1$, $Pnewer_2$ operate respectively on the same channels as ($P_0$, $Pnew_0$), ($P_1$, $Pnew_1$), and ($P_2$, $Pnew_2$).

Figure 4:
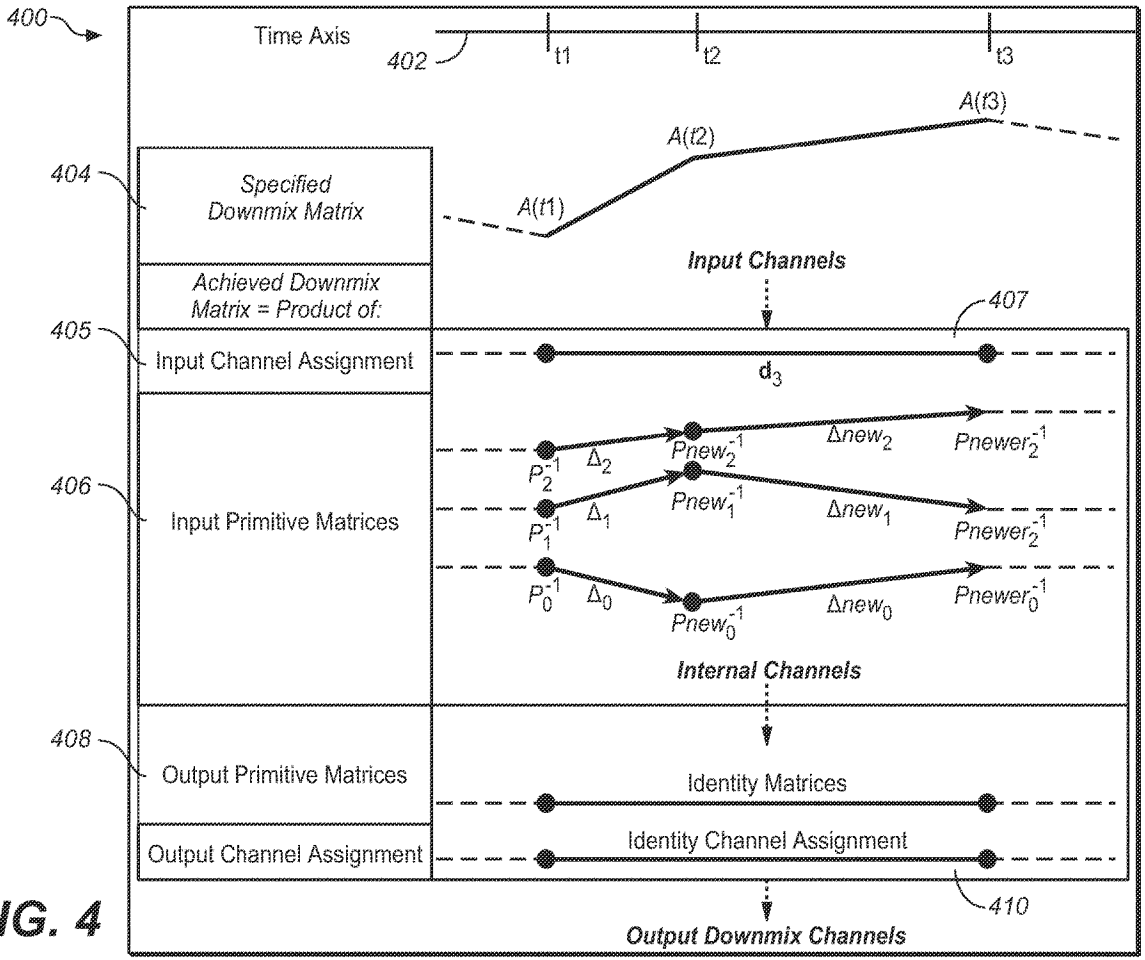
FIG. 4 is a diagram illustrating matrix updates for time-varying objects, under an embodiment in which there are continuous internal channels at time t2, and a continuous output presentation at time t2, with no audible/visible artifacts.

The system can define a new set of deltas $\Delta new_0$, $\Delta new_1$, $\Delta new_2$, based on interpolating the input primitive matrices between time t2 and t3. This is conceptualized in FIG. 4, which illustrates matrix updates along time axis 402 for time-varying objects, under an embodiment. As shown in FIG. 4, there are continuous internal channels at time t2 and a continuous output presentation at time t2, with no audible/visible artifacts. The same output matrices 408 work at times t1, t2 and t3. The input primitive matrices 406 can be interpolated to achieve a continuously varying matrix 404 that results in no discontinuity in the downmix audio at time t1. In this case, at time t2 there is no need to retransmit the following information in the bitstream: input channel assignment, the output channel assignment output primitive matrices, and the order in which the primitive matrices in the lossless substream (and hence input primitive matrices) are to be applied. What does get updated at time t2 is just the "delta" or difference information that defines the new trajectory that the input primitive matrices must take from time t2 to t3. Note that the system does not need to transmit $Pnew_0$, $Pnew_1$, $Pnew_2$ the initial primitive matrices of the interpolation segment t2 t3, since they are essentially the end primitive matrices for the interpolation segment t1 to t2.

The achieved matrix is the cascade of channel assignments 405 and primitive matrices 406 as shown in FIG. 4. Since the input matrices 406 are continuously varying due to the interpolation, and the output matrices 408 are a constant, the achieved downmix matrix varies continuously. In this case the transfer function/matrix that converts the input channels to internal channels 407 is continuous at t2, and hence the resultant internal channels will not possess a discontinuity at t2. Note that this is desirable behavior since the internal channels will eventually be subjected to linear predictive coding (to recoup coding gains due to prediction across time) which is most efficient when the signal to be coded is continuous across time. Further, the output downmix channels 410 also possess no discontinuities.

As described previously, A(t2) can be decomposed in a second way (decomposition 2), that involves applying a rotation Z to the required specification to obtain B(t2), and leads to output matrices $Q_0$, $Q_1$ that are not identity matrices that compensate for the rotation. The decomposition of B(t2) into input primitive matrices and input channel assignment, is follows:

$$\begin{bmatrix} -0.6255 & -0.6136 & -0.6136 \\ 0 & 0.2927 & -0.2926 \\ 1 & 2.5797 & -6.0792 \end{bmatrix} = \underbrace{\begin{bmatrix} 1 & 0 & 0 \\ 0.2927 & 1 & 0.1831 \\ 0 & 0 & 1 \end{bmatrix}}_{S_0^{-1}}$$

$$\underbrace{\begin{bmatrix} 1 & -4.4161 & -0.6255 \\ 0 & 1 & 0 \\ 0 & 0 & 1 \end{bmatrix}}_{S_1^{-1}} \underbrace{\begin{bmatrix} 1 & 0 & 0 \\ 0 & 1 & 0 \\ 2.5797 & -6.0792 & 1 \end{bmatrix}}_{S_2^{-1}} \underbrace{\begin{bmatrix} 0 & 1 & 0 \\ 0 & 0 & 1 \\ 1 & 0 & 0 \end{bmatrix}}_{D_3}$$

In the above equation, the notation $S_0$, $S_1$, $S_2$ is used to distinguish from the alternate set of input primitive matrices $Pnew_0$, P $new_1$, P $new_2$ at the same time t2, that feature in FIG. 4.

Note that the same input channel assignment $d_3$ is used. Further assume that (unlike what was assumed in the earlier example), it is not possible to decompose A(t3) such that the output matrices are identity matrices, but it is instead possible to apply the same rotation Z on A(t3) so that its decomposition satisfies the following conditions:

(1) the output matrices are matrices $Q_0$, $Q_1$ (2) the same input channel assignment $d_3$ at time t1 and t2 also works at t3

(3) and the new primitive matrices $Snew_0$, $Snew_1$, $Snew_2$ operate respectively on the same channels as $S_0$, $S_1$, $S_2$.

Figure 5:
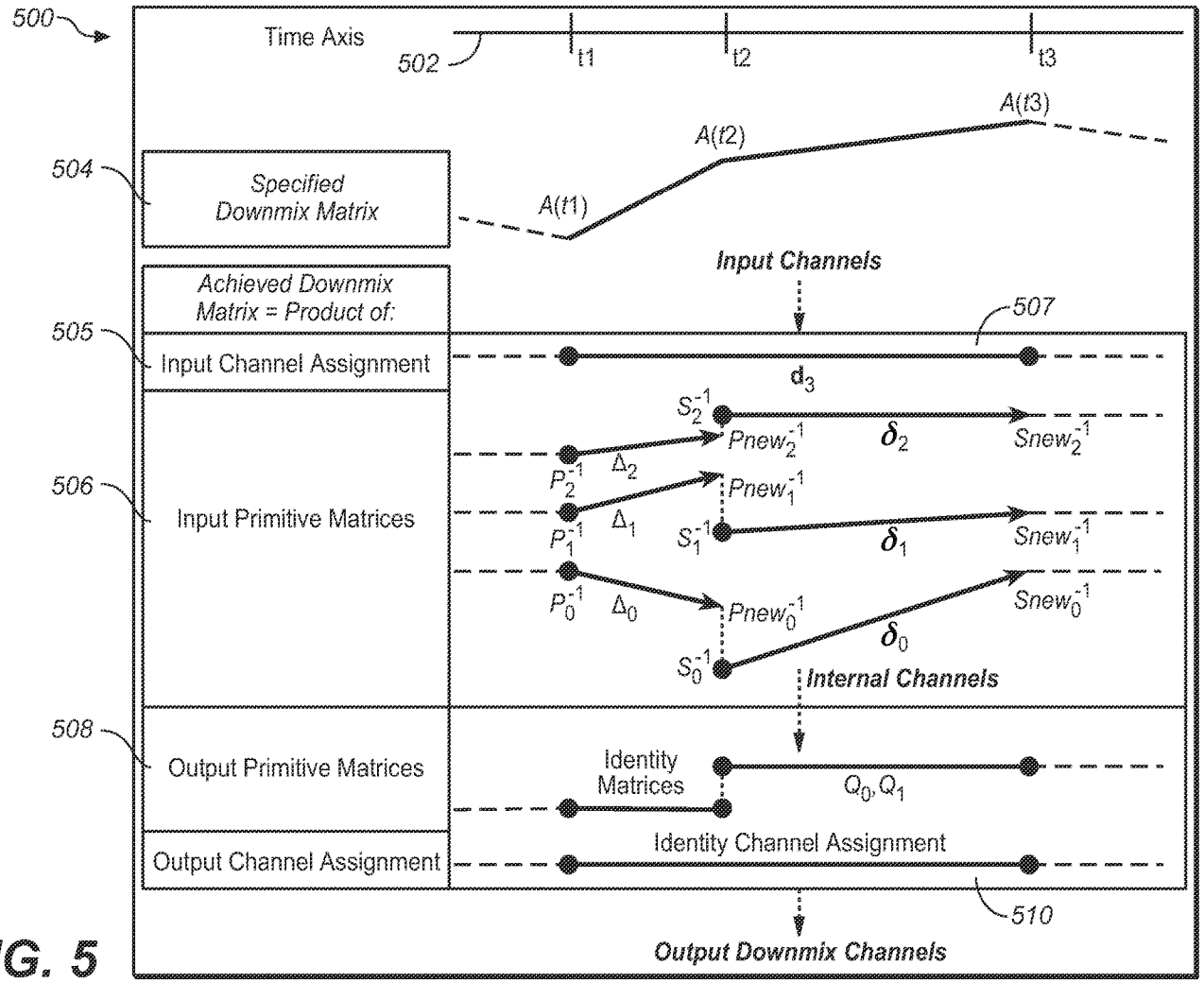
FIG. 5 is a diagram illustrating matrix updates for time-varying objects, under an embodiment in which there are discontinuous internal channels at t2 due to discontinuity in input primitive matrices, and a continuous output presentation at time t2 with no audible/visible artifacts, but the discontinuity in the input matrices is compensated by a discontinuity in output matrices.

In this case, the input primitive matrices can be interpolated between time t1 and t2 such that the output matrices for the downmix substream during that time are identity matrices, and between t2 to t3 such that the output matrices are $Q_0$, $Q_1$. This situation is illustrated in FIG. 5, which illustrates matrix updates for time-varying objects along time axis 502, under an embodiment in which there are discontinuous internal channels at t2 due to discontinuity in input primitive matrices, and a continuous output presentation at time t2 with no audible/visible artifacts. As shown in FIG. 5, the specified matrix 504 at time t2 can be decomposed into input and output primitive matrices 506, 508 in two different ways. It may be necessary to use one decomposition to be able to interpolate from t1 to t2, and another from t2 to t3. In this case, at time t2 we will necessarily have to transmit the primitive matrices $S_0$, $S_1$, $S_2$ (starting point of the interpolation segment t2 to t3). It will also be necessary to update the output matrices 508 to $Q_0$, $Q_1$ for the downmix substream. The transfer function from input channels 505 to internal channels 507, and hence the internal channels themselves will have a discontinuity at time t2: since the input primitive matrices abruptly change at that point. However, the overall achieved matrix is still continuous at t2, and the discontinuity in the input primitive matrices 506 is compensated for by the discontinuity in the output matrices 508. The discontinuity in the internal channels creates a harder problem for the linear predictor (lesser compression efficiency) but there is still no discontinuity in the output downmix 510. So in essence it would be preferable to be able to create audio segments over which we have a situation similar to that in FIG. 4, rather than in FIG. 5.

For arbitrary matrix trajectories there may be consecutive time instances t2 and t3, with corresponding matrices A(t2) and A(t3), where it may not be possible to employ the same output matrices in the decompositions of the two consecutive matrices; or the two decompositions may require different output channel assignments; or the two sequences of channels corresponding to input primitive matrices at the two instants of time are different so that deltas/interpolation slopes cannot be defined. In such a case the deltas between time t2 and t3 have to be necessarily set to zero, which will result in a discontinuity in both internal channels and downmix channels at time t3, i.e., the achieved matrix trajectory is a constant (not interpolated) between t2 and t3.

Embodiments are generally directed to systems and methods for segmenting audio into sub-segments over which the non-interpolateable output matrices can be held constant, while achieving a continuously varying specification by interpolation of input primitive matrices with ability to correct the trajectory by updates of the delta matrices. The segments are designed such that the specified matrices at the boundaries of such sub-segments can be decomposed into primitive matrices in two different ways, one that is amenable for interpolation up to the boundary and one that is amenable for interpolation from the boundary. The process also marks segments which require a fallback to no interpolation.

One process of the method involves holding primitive matrix channel sequences constant. As has been previously stated, each primitive matrix is associated with a channel it operates on or modifies. For instance, consider the sequence of primitive matrices $S_0$, $S_1$, $S_2$ (the inverses of which are shown in the above). These matrices operate on Ch1, Ch0, and Ch2, respectively. Given a sequence of primitive matrices, the corresponding sequence of channels are referred to by the term "primitive matrix channel sequence." The primitive matrix channel sequence is defined for individual substreams separately. The "input primitive matrix channel sequence" is the reverse of the primitive matrix channel sequence of the topmost substream (for lossless inversion). In the example of FIG. 4, the input primitive matrix channel sequence is the same at times t1, t2, and t3, which was a necessary condition to compute deltas for interpolation of input primitive matrices through those time instants. It just so happens in the example of FIG. 5 that $S_0$, $S_1$, $S_2$ operate on the same channels as $Pnew_0$, $Pnew_1$, $Pnew_2$, and hence even here the input primitive matrix channel sequence is the same at times t1, t2, t3. In the bitstream syntax for non-legacy substreams it is possible to share the primitive matrix channel sequence between consecutive matrix updates, i.e., send it only once and reuse multiple times. Thus, it may be desirable to achieve audio segmentation such that infrequent transmission of the primitive matrix channel sequence is affected.

It has been largely assumed that downmixes need to be backward compatible, but more generally none or a subset of the downmixes may be backward compatible. In the case of non-legacy downmixes there is no necessity to maintain output matrices constant, and they could in fact be interpolated. However to be able to interpolate it should be possible to define output matrices at consecutive instants in time such that they correspond to the same primitive matrix channel sequence (otherwise the slope for the interpolation path is undefined).

The general philosophy of certain embodiments is to affect audio segmentation when the specified matrices are dynamic, so that one or more encoding parameters can be maintained a constant over the segments while minimizing the impact (if any) of the change in the encoding parameter at the segmentation boundary on compression efficiency, continuity in the downmix audio (or audibility of discontinuities) or some other metric.

Embodiments of the segmentation process may be implemented as a computer executable algorithm. For this algorithm, the continuously varying matrix trajectory from the adaptive audio/lossless presentation to the largest downmix is typically sampled at a high-rate, for instance, at every access unit (AU) boundary. A finite sequence of matrices $\Lambda_0=\{A(t_j)\}$ where j is an integer $0\leq j<J$, and $t_0<t_1<t_2<\ldots$, covering a large length of audio (say, 100000 AUs) is created. We will denote by $\Lambda_0(j)$ the element with index j in the sequence $\Lambda_0$. For instance, $\Lambda_0$ contains a sequence of matrices that describe how to downmix from Atmos to a 7.1ch speaker layout. The sequence $\Lambda_1$ is then the sequence of J matrices at the same time instants $t_j$ that define how to downmix to the next lower downmix. For instance, each of these J matrices could simply be the static 7.1 to 5.1ch matrix. One can similarly create K sequences, corresponding to the K downmixes in the cascade. The audio segmentation algorithm receives the K time stamps $\Gamma=\{t_j\}$, $0\leq j<J$. The output of the algorithm is a set of encoding decisions for audio in time $[t_0, t_{J-1})$. Certain steps of the algorithm are as follows:

1. A pass through the matrix sequence(s) going forward in time from $t_0$ to $t_{J-1}$ is performed. In this pass at each instant $t_j$ the algorithm tries to determine a set of encoding decisions $E_j$ that can be used to achieve the downmixes specified by $\Lambda_k(j)$, $0\leq k<K$. Here $E_j$ could include elements such as the channel assignments, the primitive matrix channel sequence, and primitive matrices for the K substreams that directly appear in the bitstream, or other elements such as the rotation Z that assist in the design of primitive matrices but do not by themselves appear in the bitstream. In doing so, it first checks if a subset of the decisions $E_{j-1}$ could be reused, where the subset corresponds to the parameters that we would like changing as infrequently as possible. This check could be performed for instance, by a variation of Algorithm 1 referenced above. Note that in Step B.3 of Algorithm 1, the process tried to select a bunch of rows and columns that eventually determines the input primitive matrix channel sequence and input channel assignment. Such steps of Algorithm 1 could be skipped (since these decisions would be copied from $E_{j-1}$), and go directly to the actual decomposition routine in Step B.4 of Algorithm 1. One or more conditions may need to be satisfied for the check to pass: the primitive matrices designed by reusing $E_{j-1}$ may need to be such that their cascade is different from the specified downmix matrix/matrices at time $t_j$ to within a threshold, or the primitive matrices must have coefficients that are bounded to within limits set by the bitstream syntax, or an estimate of the peak excursion in internal channels on application of the primitive matrices may need to be bounded (to avoid datapath overloads), etc. If the check does not pass, or if there is no valid $E_{j-1}$ the decisions $E_j$ may be determined independently for the matrix specification at time $t_j$, for instance by running Algorithm 1 as is. Whenever decisions $E_{j-1}$ are not compatible with the matrices at time $t_j$, a segmentation boundary is inserted. This indicates, for instance, that the segment contained in time $t_{j-1}$ to $t_j$ may not have an interpolated matrix trajectory, and that the achieved matrix suddenly changes at $t_j$. This of course is undesirable since this would indicate that there is a discontinuity in the downmix audio. It may also indicate that a new restart interval starting at $t_j$ may be required. The encoding decisions $E_j$, $0\leq j<J$ are preserved.

2. Next a pass through the matrix sequence(s) going backward in time from $t_{J-1}$ to $t_0$ is performed. In doing so the process checks if a subset of the decisions $E_{j+1}$ are amenable for matrix decomposition at time $t_j$ (i.e., pass the same checks as in (1) above). If so we redefine $E_j$ as the new set of encoding decisions, and move back in time any segmentation boundaries that may have been currently inserted at time $t_j$. The impact of this step may be that even though the time interval $t_j$ to $t_{j+1}$ may have been marked as not having interpolated primitive matrices in step (1) above, we indeed could use interpolated matrices there by reusing a subset of the decisions $E_{j+1}$ at time $t_j$. Thus $t_{j+1}$ which may have been predicted as a point of discontinuity in step (1), will no more be so. This step may also help to spread out restart intervals more evenly, possibly minimizing peak data rates for encoding. This step may further help identifying points such as t2 in FIG. 5 where the specified matrix can be decomposed in two different ways into primitive matrices, which helps achieve a continuously varying matrix trajectory despite an update to output primitive matrices. For instance, assume in step (1) above $E_{j-1}$ was amenable for decomposition of the matrices at time $t_j$. However, the resulting $E_j$ was not amenable for decomposition of the matrices at $t_{j+1}$. There may then have been introduced a segmentation boundary at time $t_{j+1}$. In the current step, it may be discovered that the decisions $E_{j+1}$ are also amenable for matrix decomposition at time $t_j$. In this case the matrices at time $t_j$ can be decomposed in two different ways just like at time t2 in FIG. 5, and thus introducing a segmentation boundary at $t_j$ instead of $t_{j+1}$ results in a continuously varying achieved downmix Finally, this step may also help identify segments $t_j$ to $t_{j+1}$ that are definitely not amenable for interpolation, or definitely require a parameter change (since it has now already tried maintaining the set of encoding parameters the same from either direction in time). In yet other cases, the process may have a choice of whether the boundary should be moved or not. For instance, it may be possible to continue to $E_{j+1}$ at not only $t_j$ but also $t_{j-1}$. In this case if there was a segmentation boundary introduced at $t_{j+1}$ in Step (1) above, it could be moved back to $t_j$ or further back to $t_{j-1}$. In such a case other metrics may determine how far the boundary should be moved. For instance, we may need to maintain restart intervals of a particular length (e.g., >=8 AUs and <=128 AUs) that may affect this decision. Or the decision may be based on a heuristic of which decisions lead to the best compression performance, or which decisions lead to the least peak excursions in internal channels.

3. The process may now compute restart intervals as continuous audio segments (or groups of consecutive matrices in the specified sequences) over which the channel assignments for all substreams have been maintained the same. The computed restart intervals may exceed the maximum length for a restart interval specified in the TrueHD syntax. In this case large intervals are split into smaller intervals by suitably inserting segmentation points at points $t_j$ in the interval where there already exist specified matrices. Alternatively, the points where the split has been affected may not have any matrices already we may even appropriately insert matrices (by repetition or interpolation) at the newly introduced segmentation points.

4. At the end of step 3 there may yet be some chunks of audio/matrix updates (i.e., corresponding to partial sequences the time stamps $\Gamma$) that have not been associated with encoding decisions yet. For instance, neither Algorithm 1 nor its variant as described in step (1) above may result in primitive matrices that have all coefficients well bounded for a partial sequence. In such cases the matrix updates within this partial sequence be simply discarded (if the sequence is small). Alternatively, such a sequence may be individual processed through the steps (1), (2), (3) above but using as a basis a different matrix decomposition algorithm (other than Algorithm 1). The results may be less optimal, nevertheless valid.

For the above algorithm, when trying out decisions $E_{1-1}$ or $E_{j+1}$ at time $t_j$ in Step (1) or Step (2) above, respectively, one may encounter a situation where the rank of one or more of the downmixes specified by matrices $\Lambda_k(j)$ decreases from the rank of its neighbors $\Lambda_k(j-1)$ or $\Lambda_k(j+1)$. This may lead to, for instance, the specified matrices at time $t_j$ requiring a fewer number of primitive matrices for its decomposition than at time $t_{j-1}$ or $t_{j+1}$. Nevertheless it can force a reuse of decisions $E_{j-1}$ or $E_{j+1}$ (as the case may be) at time $t_j$ by inserting trivial primitive matrices in the sequence of input or output primitive matrices in the decomposition to get the same number (and primitive matrix channel sequences) as at neighboring time instants.

Once the segmentation has been accomplished, the process can recalculate encoding decisions for each segment separately if there is benefit to doing so. For instance, the segmentation may have led to encoding decisions that might be most optimal for one end of a segment while not as optimal for the opposite end. It may then try a new set of encoding decisions which may be optimal for matrices in the center of the segment, which overall may result in an improvement in objective metrics such as compression efficiency or peak excursion of internal channels.

Encoder Design

Figure 6:
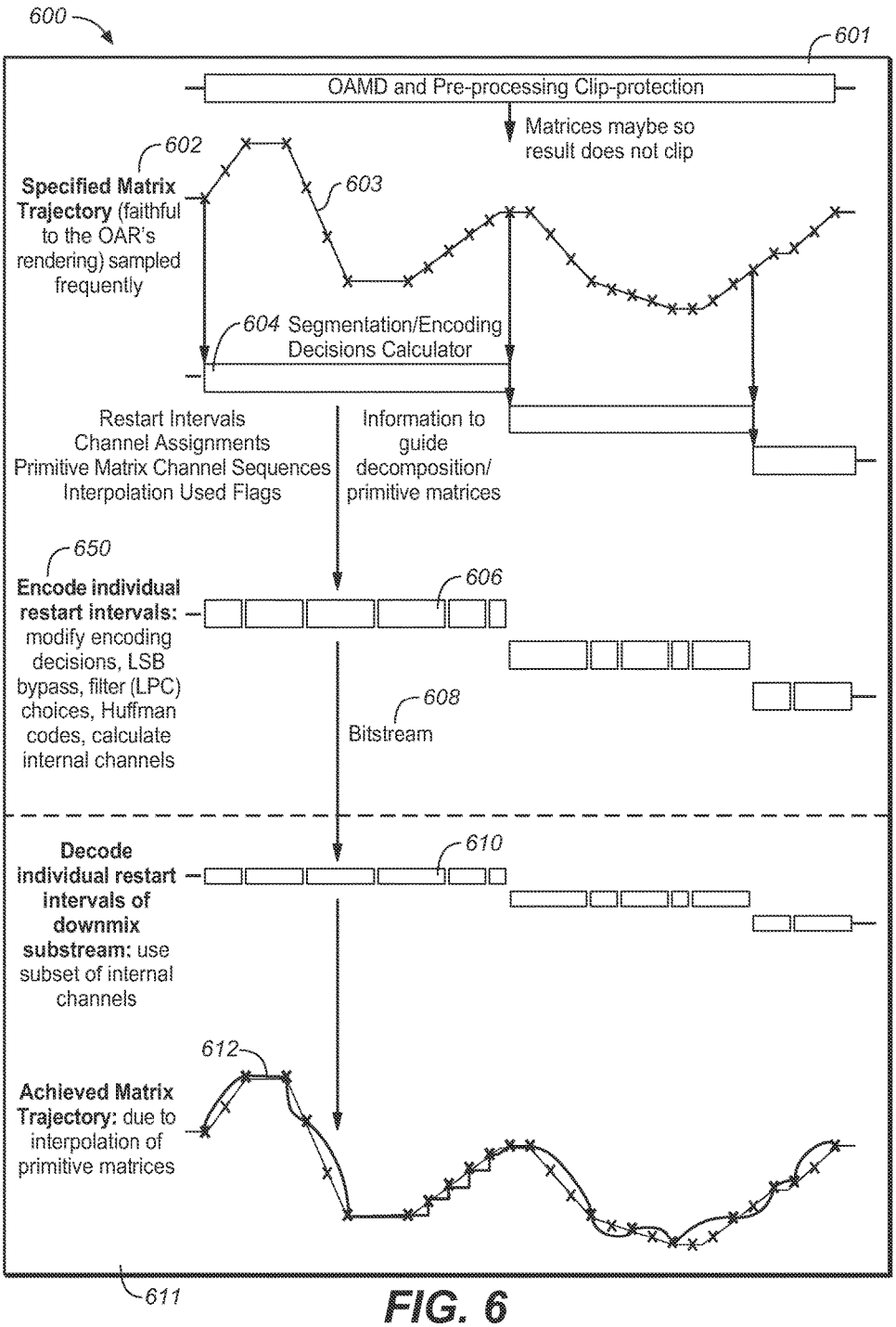
FIG. 6 illustrates an overview of the adaptive audio TrueHD system including an encoder and decoder, under an embodiment.

In an embodiment, the audio segmentation process described above is performed in an encoder stage of an adaptive audio processing system for rendering adaptive audio TrueHD content with interpolated matrixing. FIG. 6 illustrates an overview of an adaptive audio TrueHD processing system including an encoder 601 and decoder 611, under an embodiment. As shown in diagram 600, the object audio metadata/bed labels in the adaptive audio (e.g., Atmos) content provide the required information to construct a rendering matrix 602 that appropriately mixes the adaptive audio content to a set of speaker feeds. The continuous motion of objects is captured in the rendering by a continuously evolving matrix trajectory generated by the object audio renderer (OAR). The continuity of the matrix trajectory may either be due to continuously evolving metadata, or due to interpolation of metadata/matrix samples. In an embodiment, a matrix generator generates samples of this continuously varying matrix trajectory as shown by the "x" marked sampling points 603 on the matrix trajectory 602. These matrices may have been modified so that they are clip-protected, i.e., when applied (with an assumed interpolation path between samples) to the input audio will result in an un-clipped downmix/rendering.

A large number of consecutive matrix samples/or matrices for a large segment of audio are processed together by an audio segmentation component 604 that executes a segmentation algorithm (such as described above) that divides the segment of audio into smaller sub-segments over which various encoding decisions such as channel assignments, primitive matrix channel sequence, whether primitive matrices are to be interpolated over the segment or not, etc. are held unchanged. The segmentation process 604 also marks groups of segments as a restart interval, as described previously herein. The segmentation algorithm thus naturally makes a significant number of encoding decisions for each segment in the segment of audio to provide information that guides the decomposition of the matrices into primitive matrices.

Figure 7:
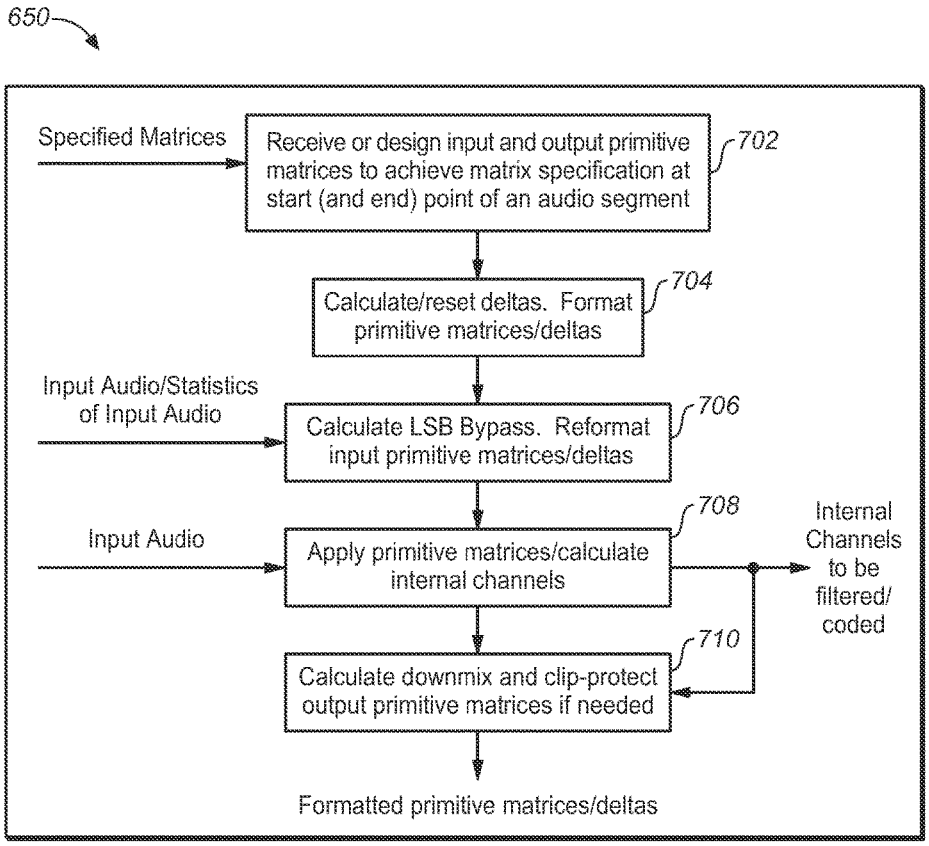
FIG. 7 is a flowchart that illustrates an encoder process to produce an output bitstream for an audio segmentation process, under an embodiment.

The decisions and information from the segmentation process 604 are then conveyed to a separate encoder routine 650 that processes audio in a group or groups 606 of such segments (the group may be a restart interval, for instance, or it may just be one segment). The objective of this routine 650 is to eventually produce the bitstream corresponding to the group of segments. FIG. 7 is a flowchart that illustrates an encoder process performed by an encoder routine 650 to produce an output bitstream for an audio segmentation process, under an embodiment. As shown in FIG. 7, encoder routine 650 may run per restart interval, or per segment to produce the bitstream for the restart segment, under an embodiment. The encoder routine receives specified matrices comprising the specified matrix trajectory 602 to achieve a matrix specification at the start (and end) point of an audio segment, 702. The encoding decisions received from the segmentation process 604 may already include primitive matrices at segment boundaries. Alternatively, it could include guidance information to generate these primitive matrices afresh by matrix decomposition (such as described previously). The encoder routine 650 then calculates the delta matrices which represent the interpolation slope, based on the primitive matrices at the ends of a segment, 704. It may reset the deltas if the segmentation algorithm has already indicated that interpolation is to be switched off during the segment, or it if the calculated deltas are not representable within the constraints of the syntax.

The encoder routine calculates or estimates the peak sample values in the internal channels that will result once the primitive matrices (with interpolation) are applied to the input audio in the segment(s) it is processing. If it is estimated that any of the internal channels may exceed the datapath/overload, the routine appropriately employs an LSB bypass mechanism to reduce the amplitude of the internal channels and in the process may modify and reformat the primitive matrices/deltas that have already been calculated, 706. It will subsequently apply the formatted primitive matrices to the input audio and create internal channels, 708. It may also make new encoding decisions such as calculation of linear prediction filters or Huffman code books to encode the audio data. The primitive matrix application step 708 takes the input audio as well as the reformatted primitive matrices/deltas to produce the internal channels that are to be filtered/coded. The calculated internal channels are then used to calculate the downmix and clip-protected output primitive matrices, 710. The formatted primitive matrices/deltas are then output from encoder routine 650 for transmission to the decoder 611 through bitstream 608.

For the embodiment of FIG. 6, the decoder 611 decodes individual restart intervals of the downmix substream and may regenerate a subset of the internal channels 610 from the encoded audio data and apply a set of output primitive matrices contained in the bitstream 608 to generate a downmix presentation. The input or output primitive matrices may be interpolated, and the achieved matrix specification is the cascade of the input and output primitive matrices. Therefore, the achieved matrix trajectory 612 may match/closely match the specified matrix trajectory 602 at only certain sample points (e.g., 603). By sampling the specified matrix trajectory at a high rate (prior to input to the segmentation algorithm in the encoder) it can be ensured that the achieved matrix trajectory does not diverge by a large amount from the specified matrix trajectory, wherein a defined threshold value may set the limits of divergence based on specific application needs and system constraints.

In some cases, since the achieved matrix trajectory is different from the specified matrix trajectory, the clip-protection implemented by the matrix generator may be insufficient. The encoder may calculate a local downmix and modify the output primitive matrices to ensure that the presentation produced by the decoder after applying the output primitive matrices does not clip, as shown in step 710 of FIG. 7. This second round of clip-protection, while necessary, may be mild in that a large amount of the clip-protection might already be absorbed into the clip-protection already applied by the matrix generator.

In some embodiments, the overall encoder routine 650 may be parallelized so that the audio segmentation routine and the bitstream producing routine (FIG. 7) may be suitably pipelined to operate simultaneously on different segments of audio. Also, audio segmentation of non-overlapping input audio sections may be parallelized as there is no dependency between segmentation of different sections.

According to embodiments, the encoder 601 includes in it an audio segmentation algorithm that designs segments to handle dynamics of the trajectory of the downmix matrix encoding process. The audio segmentation algorithm divides the input audio into consecutive segments and produces an initial set of encoding decisions and sub-segments for each segment, and then processes individual sub-segments or groups of sub-segments within the audio segment to produce the eventual bitstream. The encoder comprises a lossless and hierarchical audio encoder that achieves a continuously varying matrix trajectory via interpolated primitive matrices, and clip-protects the downmix by accounting for this achieved trajectory. The system may have two rounds of clip-protection, one in a matrix generation stage and one after the primitive matrices have been designed.

Formatting Primitive Matrices/Deltas

With reference to FIG. 7 and the step of formatting primitive matrices and deltas as shown in 704 of FIG. 7, the following algorithm may be used to perform this step. Coefficients in primitive matrices in TrueHD can be represented as a mantissa and an exponent. A primitive matrix may be associated with an exponent referred to as "cfShift" that all coefficients in the primitive matrix share. A specific coefficient $\alpha$ in the primitive matrix may be packed into the bitstream as the mantissa $\lambda$ such that $\lambda=\alpha\times 2^{-cfShift}$. The mantissa should satisfy the following constraint: $-2\leq\lambda<2$, while the exponent $-1\leq cfShift<7$. Thus very large coefficients (>128 in absolute value) may not be representable in the TrueHD syntax and it is the job of the encoder to determine encoding decisions that do not imply primitive matrices with large coefficients. The mantissa is further represented as a binary fraction with a resolution of "fracBits", i.e., $\lambda$ will be represented with (fracBits+2) bits in the bitstream. Each primitive matrix is associated with a single value of "fracBits", which can have integer values between 0 to 14.

With reference to FIG. 2, at time t2 the system will necessarily have to transmit the primitive matrices $S_0$, $S_1$, $S_2$ (starting point of the interpolation segment t2 to t3). The primitive matrices at the beginning of an interpolation segment are called "seed primitive matrices". These are the primitive matrices that are transmitted in the bitstream. The primitive matrices at intermediate points in an interpolation segment are generated utilizing delta matrices.

Each seed primitive matrix is associated with a corresponding delta matrix (if that primitive matrix is not interpolated the deltas could be thought of as zero), and thus each coefficient $\alpha$ in a primitive matrix has a corresponding coefficient $\delta$ in the delta matrix. The value of $\delta$ is represented in the bitstream as follows: (a) The normalized value $\theta=\delta\times 2^{-cfShift}$ is calculated, where cfShift is the exponent associated with the corresponding seed primitive matrix. It is required that $-1\leq\theta<1$ for all coefficients in the delta matrix. (b) The normalized value is then packed into the bitstream as an integer g represented with "deltaBits"+1 bits, such that $\theta=g\times 2^{-fracBits-deltaPrecision}$. The parameter deltaPrecision indicates the extra precision to represent the deltas more finely the primitive matrix coefficients themselves. Here deltaBits can be 0 to 15, while deltaPrecision has value between 0 and 3.

As stated above, the system requires a cfShift that ensures that $-1\leq\theta<1$ and $-2\leq\lambda<2$ for all coefficients in a seed and corresponding delta matrix. If no such cfShift, where $-1\leq cfShift<7$, exists, then the encoder may switch off interpolation for the segment, zero out the deltas, and calculate a cfShift purely based on the seed primitive matrix. This algorithm provides the advantage of providing switching off interpolation as a fall back when deltas are not representable. This may be either part of the segmentation process or in a later encoding module that might need to determine the quantization parameters associated with seed and delta matrices.

Encoder/Decoder Circuit

Figure 8:
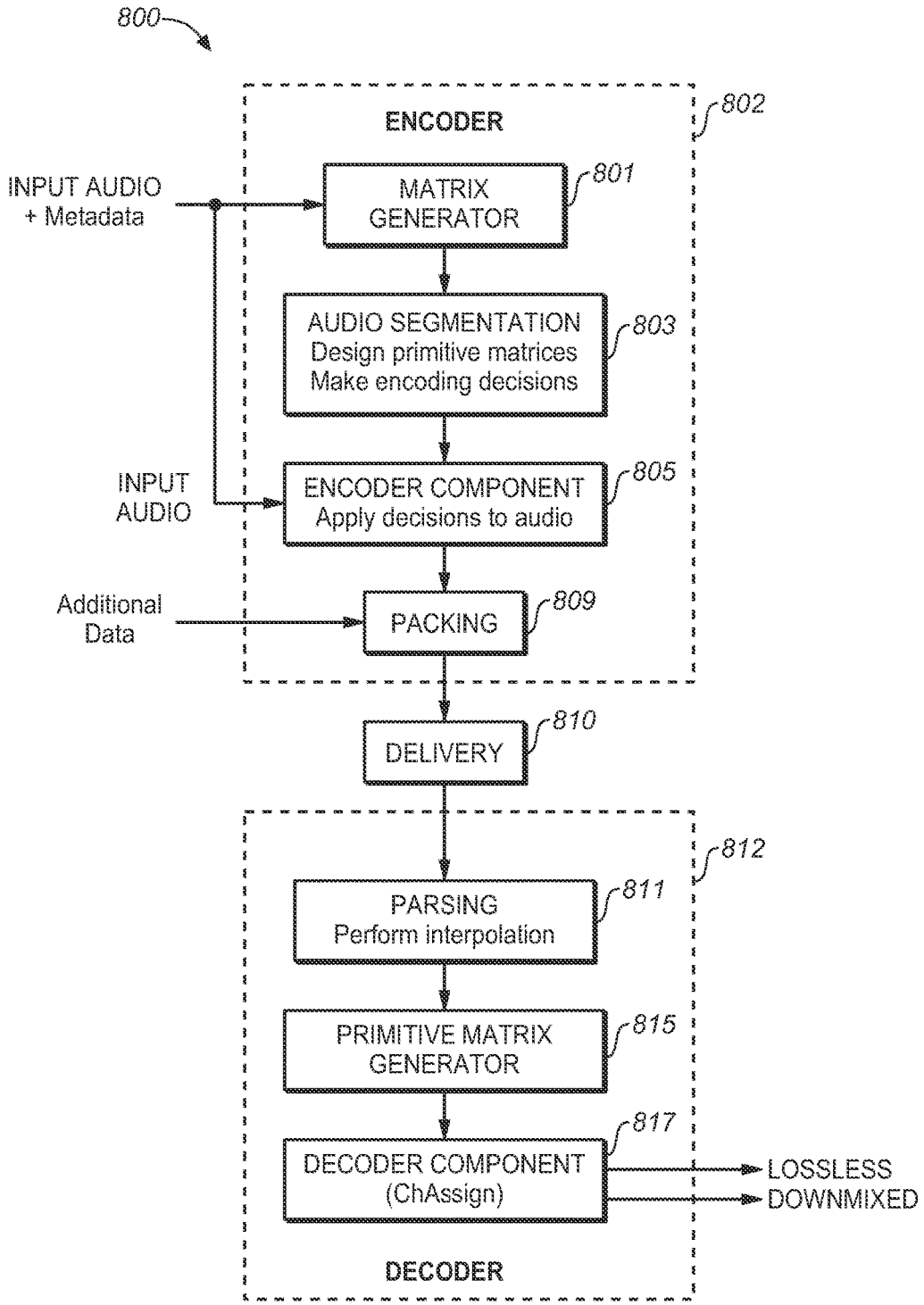
FIG. 8 is a block diagram of an audio data processing system that includes an encoder performing audio segmentation and encoding processes, and coupled to a decoder through a delivery sub-system, under an embodiment.

Embodiments of the audio segmentation process may be implemented in an adaptive audio processing system comprising encoder and decoder stages or circuits. FIG. 8 is a block diagram of an audio data processing system that includes an encoder 802, delivery subsystem 810, and decoder 812, under an embodiment. Although subsystem 812 is referred to herein as a "decoder" it should be understood that may be implemented as a playback system including a decoding subsystem (configured to parse and decode a bitstream indicative of an encoded multichannel audio program) and other subsystems configured to implement rendering and at least some steps of playback of the decoding subsystem's output. Some embodiments may include decoders that are not configured to perform rendering and/or playback (and which would typically be used with a separate rendering and/or playback system). Some embodiments of the invention are playback systems (e.g., a playback system including a decoding subsystem and other subsystems configured to implement rendering and at least some steps of playback of the decoding subsystem's output.

In system 800 of FIG. 8, encoder 802 is configured to encode a multi-channel adaptive audio program (e.g., surround channels plus objects) as an encoded bitstream including at least two substreams, and decoder 812 is configured to decode the encoded bitstream to render either the original multi-channel program (losslessly) or a downmix of the original program. Encoder 802 is coupled and configured to generate the encoded bitstream and to assert the encoded bitstream to delivery system 810. Delivery system 810 is coupled and configured to deliver (e.g., by storing and/or transmitting) the encoded bitstream to decoder 812. In some embodiments, system 800 implements delivery of (e.g., transmits) an encoded multichannel audio program over a broadcast system or a network (e.g., the Internet) to decoder 812. In some embodiments, system 800 stores an encoded multichannel audio program in a storage medium (e.g., non-volatile memory), and decoder 812 is configured to read the program from the storage medium.

Encoder 802 includes a matrix generator component 801 that is configured to generate data indicative of the coefficients of rendering matrices, with the rendering matrix is updated periodically, so that the coefficients are likewise updated periodically. Rendering matrices are ultimately converted to primitive matrices which are sent to packing subsystem 809 and encoded in the bitstream indicating relative or absolute gain of each channel to be included in a corresponding mix of channels of the program. The coefficients of each rendering matrix (for an instant of time during the program) represent how much each of the channels of a mix should contribute to the mix of audio content (at the corresponding instant of the rendered mix) indicated by the speaker feed for a particular playback system speaker. The encoded audio channels, primitive matrix coefficients and the metadata that drives the matrix generator 801, and typically also additional data are asserted to packing subsystem 809, which assembles them into the encoded bitstream which is then asserted to delivery system 810. The encoded bitstream thus includes data indicative of the encoded audio channels, the sets of time-varying matrices, and typically also additional data (e.g., metadata regarding the audio content).

The matrices generated by matrix generator 801 may trace a specified matrix trajectory 602 as shown in FIG. 6. For the embodiment of FIG. 8, the matrices generated by matrix generator 801 are processed in an audio segmentation component 803 that divides the segment of audio into smaller sub-segments over which various encoding decisions such as channel assignments, primitive matrix channel sequence, whether primitive matrices are to be interpolated over the segment or not, etc. are held unchanged. This component also marks groups of segments as a restart interval, as described previously. The audio segmentation component 803 thus functions to decompose the matrices of the matrix trajectory 602 into respective sets of primitive matrices and channel assignments.

The decisions and primitive matrices information is provided to an encoder component 805 that processes audio in the defined sub-segments by applying the decisions made by component 803. Operation of the encoder component 805 may be performed in accordance with the process flow of FIG. 7. In an embodiment, the data processed in system 800 may be referred to as "internal" channels since a decoder (and/or rendering system) typically decodes and renders the content of the encoded signal channels to recover the input audio, so that the encoded signal channels are "internal" to the encoding/decoding system. The encoder 805 generates a bitstream corresponding the group of sub-segments defined by the audio segmentation component 803. The encoder component 805 outputs updated primitive matrices and also any appropriate interpolation values to enable decoder 812 to generate interpolated versions of the matrices. The interpolation values are included by packing stage 809 in the encoded bitstream output from encoder 802.

With reference to decoder 812 of FIG. 8, the parsing subsystem 811 is configured to receive the encoded bitstream from delivery system 810 and to parse the encoded bitstream. The decoder 812 regenerates the internal channels from the encoded audio data and applies a set of output primitive matrices contained in the bitstream to generate a downmix presentation. The achieved matrix specification is the cascade of the input and output primitive matrices. An interpolation stage in parser 811 in decoder 812 receives seed and updated sets of primitive matrices included in the bitstream, and the interpolation values also included in the bitstream to generated interpolated values of each seed matrix. The primitive matrix generator 815 is a matrix multiplication subsystem configured to apply sequentially each sequence of primitive matrices output from interpolation stage 813 to the encoded audio content extracted from the encoded bitstream. A decoder component 817 is configured to recover losslessly the channels of at least a segment of the multichannel audio program that was encoded by encoder 802. A permutation stage (ChAssign) of decoder 812 may also be included to output one or more downmixed presentations.

Embodiments are directed to an audio segmentation and matrix decomposition process for rendering adaptive audio content using TrueHD audio codecs, and that may be used in conjunction with a metadata delivery and processing system for rendering adaptive audio (hybrid audio, Dolby Atmos) content, though applications are not so limited. For these embodiments, the input audio comprises adaptive audio having channel-based audio and object-based audio including spatial cues for reproducing an intended location of a corresponding sound source in three-dimensional space relative to a listener. The sequence of matrixing operations generally produces a gain matrix that determines the amount (e.g., a loudness) of each object of the input audio that is played back through a corresponding speaker for each of the N output channels. The adaptive audio metadata may be incorporated with the input audio content that dictates the rendering of the input audio signal containing audio channels and audio objects through the N output channels and encoded in a bitstream between the encoder and decoder that also includes internal channel assignments created by the encoder. The metadata may be selected and configured to control a plurality of channel and object characteristics such as: position, size, gain adjustment, elevation emphasis, stereo/full toggling, 3D scaling factors, spatial and timbre properties, and content dependent settings.

Although certain embodiments have been generally described with respect to downmixing operations for use with TrueHD codec formats and adaptive audio content having objects and surround sound channels of various well-known configurations, it should be noted that the conversion of input audio to decoded output audio could comprise downmixing, rendering to the same number of channels as the input, or even upmixing. As stated above, certain of the algorithms contemplate the case where M is greater than N (upmix) and M equals N (straight mix). For example, although Algorithm 1 is described in the context of M<N, further discussion (e.g., Section IV.D) alludes to an extension to handle upmixes. Similarly Algorithm 4 is generic with regard to conversion and uses language such as "the smaller of $M_k$, or N," thus clearly contemplating upmixing as well as downmixing.

Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the methods and systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon). The expression "system" is used in a broad sense to denote a device, system, or subsystem. For example, a subsystem that implements a decoder may be referred to as a decoder system, and a system including such a subsystem (e.g., a system that generates Y output signals in response to multiple inputs, in which the subsystem generates M of the inputs and the other Y-M inputs are received from an external source) may also be referred to as a decoder system. The term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set. The expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing. Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions: speaker and loudspeaker are used synonymously to denote any sound-emitting transducer. This definition includes loudspeakers implemented as multiple transducers (e.g., woofer and tweeter); speaker feed: an audio signal to be applied directly to a loudspeaker, or an audio signal that is to be applied to an amplifier and loudspeaker in series; channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic; audio program: a set of one or more audio channels (at least one speaker channel and/or at least one object channel) and optionally also associated metadata (e.g., metadata that describes a desired spatial audio presentation); speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone; object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source; and object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel).

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A method, performed by an audio signal processing device, of encoding adaptive audio, the method comprising:

receiving N objects and associated spatial metadata that describes the continuing motion of these objects;

partitioning the audio into segments based on the spatial metadata, the spatial metadata defining a time-varying matrix trajectory comprising a sequence of matrices at different time instants to render the N objects to M output channels, and the partitioning step comprising dividing the sequence of matrices into a plurality of segments;

deriving a matrix decomposition for matrices in the sequence; and configuring the plurality of segments to facilitate coding of one or more characteristics of the adaptive audio including matrix decomposition parameters, wherein the plurality of segments dividing the sequence of matrices are configured such that:

one or more decomposition parameters are held constant for the duration of one or more segments of the plurality of segments; and/or the impact of any change in one or more decomposition parameters is minimal with regard to one or more performance characteristics including: compression efficiency, continuity in output audio, and audibility of discontinuities;

wherein one or more of receiving N objects and associated spatial metadata, partitioning the audio data into segments, deriving a matrix decomposition, and configuring the plurality of segments are implemented, at least in part, by one or more hardware elements of the audio signal processing device.

2. The method of claim 1, wherein the step of deriving the matrix decomposition comprises decomposing matrices in the sequence into primitive matrices and channel assignments, and wherein the matrix decomposition parameters include channel assignments, primitive matrix channel sequence, and interpolation decisions regarding the primitive matrices.

3. The method of claim 2, wherein the primitive matrices and channel assignments are encoded in a high definition audio format bitstream.

4. The method of claim 3, wherein the bitstream is transmitted between an encoder and decoder of an audio processing system for rendering the N objects to speaker feeds corresponding to the M channels.

5. The method of claim 4, further comprising decoding the bitstream in the decoder to apply the primitive matrices and channel assignments to a set of internal channels to derive a lossless presentation and one or more downmix presentations of an input audio program, and wherein the internal channels are internal to the encoder and decoder of the audio processing system.

6. The method of claim 1, wherein the segments are restart intervals that may be of identical or different time periods.

7. The method of claim 1, further comprising:

receiving one or more decomposition parameters for a matrix A(t1) at t1; and attempting to perform a decomposition of an adjacent matrix A(t2) at t2 into primitive matrices and channel assignments while enforcing the same decomposition parameters as at time t1, wherein the attempted decomposition is deemed as failed if the resulting primitive matrices do not satisfy one or more criterion, and is deemed successful if otherwise.

8. The method of claim 7, wherein the criterion to define the failure of the decomposition include one or more of the following: the primitive matrices obtained from the decomposition have coefficients whose values exceed limits prescribed by a signal processing system that incorporates the method; the achieved matrix, obtained as the product of primitive matrices and channel assignments differs from the specified matrix A(t2) by more than a defined threshold value, where the difference is measured by an error metric that depends at least on the achieved matrix and the specified matrix; and the encoding method involves applying one or more of the primitive matrices and channel assignments to a time-segment of the input audio, and a measure of the resultant peak audio signal is determined in the decomposition routine, and the measure exceeds a largest audio sample value that can be represented in a signal processing system that performs the method.

9. The method of claim 8, where the error metric is the maximum absolute difference between corresponding elements of the achieved matrix and the specified matrix A(t2).

10. The method of claim 8, where some of the primitive matrices are marked as input primitive matrices, and a product matrix of the input primitive matrices is calculated, and a value of a peak signal is determined for one or more rows of the product matrix, wherein the value of the peak signal for a row is the sum of absolute values of elements in that row of the product matrix, and the measure of the resultant peak audio signal is calculated as the maximum of one or more of these values.

11. The method of claim 7, where the decomposition is a failure and a segmentation boundary is inserted at time t1 or t2.

12. The method of claim 7, wherein the decomposition of A(t2) is a success, and wherein some of the primitive matrices are input primitive matrices and a channel assignment is an input channel assignment, and the primitive matrix channel sequence for input primitive matrices at t1 and t2, and input channel assignments at t1 and t2 are the same, and interpolation slope parameters are determined for interpolating the input primitive matrices between t1 and t2.

13. The method of claim 12, wherein the interpolation slope parameters are larger than a limit defined by the signal processing system, and the interpolation slope is set to zero for the entire time duration between t1 and t2.

14. The method of claim 7, wherein A(t1) and A(t2) are matrices in the matrix defined at time instants t1 and t2, and further comprising:

decomposing both A(t1) and A(t2) into primitive matrices and channel assignments;

identifying at least some of the primitive matrices at t1 and t2 as output primitive matrices;

interpolating one or more of the primitive matrices between t1 and t2;

deriving, in the encoding method, an M-channel downmix of the N-input channels by applying the primitive matrices with interpolation to the input audio;

determining if the derived M-channel downmix clips; and modifying output primitive matrices at t1 and/or t2 so that applying the modified primitive matrices to the N-input channels results in an M-channel downmix that does not clip.

15. An audio signal processing device for rendering adaptive audio, the audio signal processing device comprising:

an encoder receiving N objects and associated spatial metadata that describes the continuing motion of these objects;

a segmentation component partitioning the audio into segments based on the spatial metadata, the spatial metadata defining a time-varying matrix trajectory comprising a sequence of matrices at different time instants to render the N objects to M output channels, and the partitioning comprising dividing the sequence of matrices into a plurality of segments; and a matrix generation component deriving a matrix decomposition for matrices in the sequence and configuring the plurality of segments to facilitate coding of one or more characteristics of the adaptive audio including matrix decomposition parameters, wherein the plurality of segments dividing the sequence of matrices are configured such that:

one or more decomposition parameters are held constant for the duration of one or more segments of the plurality of segments; and/or the impact of any change in one or more decomposition parameters is minimal with regard to one or more performance characteristics including: compression efficiency, continuity in output audio, and audibility of discontinuities;

wherein one or more of the encoder, the segmentation component, and the matrix generation unit are implemented, at least in part, as one or more hardware elements of the audio signal processing device.

16. The audio signal processing device of claim 15, wherein the matrix decomposition decomposes matrices in the sequence into primitive matrices and channel assignments, and wherein the matrix decomposition parameters include channel assignments, primitive matrix channel sequence, and trajectory interpolation characteristics.

17. The audio signal processing device of claim 15, further comprising an encoder module encoding for each segment a plurality of encoding decisions including the decomposition parameters.

18. The audio signal processing device of claim 17, further comprising a packing component packaging the encoding decisions into a bitstream transmitted from the encoder to the decoder.

19. The audio signal processing device of claim 18, further comprising:

a first decoder component decoding the bitstream to regenerate a subset of internal channels from encoded audio data; and a second decoder component applying a set of output primitive matrices contained in the bitstream to generate a downmix presentation of an input audio program.

20. The audio signal processing device of claim 19, wherein the downmix presentation is equivalent to rendering the N objects to a number M of output channels by a rendering matrix, and wherein coefficients of the rendering matrix comprise gain values dictating how much of each object is played back through one or more of the M output channels at any instant in time.

* * * * *